United States Patent [19]

Brown

[11] Patent Number: 4,869,001

[45] Date of Patent: Sep. 26, 1989

[54] FOOT AND ANKLE ORTHOTIC FOR A SKATE BOOT OR THE LIKE, AND METHOD

[75] Inventor: Dennis N. Brown, Custer, Wash.

[73] Assignee: Superfeet In-Shoe Systems, Inc., Toronto, Canada

[21] Appl. No.: 150,193

[22] Filed: Jan. 29, 1988

Related U.S. Application Data

[63] Continuation-in-part of Ser. No. 837,584, Mar. 7, 1986, Pat. No. 4,718,179, and a continuation-in-part of Ser. No. 899,958, Aug. 25, 1986, and a continuation-in-part of Ser. No. 870,123, Jun. 3, 1986.

[51] Int. Cl.[4] ..... A43B 13/41; A43B 05/00

[52] U.S. Cl. ..... 36/115; 36/44; 128/604

[58] Field of Search ..... 36/115, 43, 44, 71, 36/88, 89, 114, 80; 2/DIG. 6; 128/596, 601, 602, 614, 619, 604

[56] References Cited

U.S. PATENT DOCUMENTS

| | | | |
|---|---|---|---|
| 2,084,455 | 6/1937 | Reed | 128/604 |
| 2,537,156 | 1/1951 | Pennell | 36/43 |
| 4,179,827 | 12/1979 | Vaccari | 36/80 |
| 4,316,333 | 2/1982 | Rothschild | 2/DIG. 6 |
| 4,520,580 | 6/1985 | Brown | 36/115 |
| 4,694,590 | 9/1987 | Greenawalt | 128/604 |
| 4,718,179 | 1/1988 | Brown | 36/71 |
| 4,760,654 | 8/1988 | Limbach | 36/43 |

FOREIGN PATENT DOCUMENTS

| | | | |
|---|---|---|---|
| 8105 | 7/1927 | Australia | 36/71 |
| 594172 | 9/1925 | France | 36/3 B |

OTHER PUBLICATIONS

Journal of the A.M.A., "Self Adhering Nylon Tapes", vol. 168, No. 7, Gershman M.D., 10/1958.

*Primary Examiner*—Steven N. Meyers
*Attorney, Agent, or Firm*—Hughes & Multer

[57] ABSTRACT

The present invention relates to an orthotic and a boot and orthotic assembly. The orthotic insert is adapted to be removably positioned in the boot and comprises a foot portion and an ankle portion. The foot and ankle portions referrably have a releasable interconnection.

The orthotic and the boot have releasable interconnecting means by which the orthotic insert can be releasably secured to the boot to restrain upward movement of the orthotic ankle portion relative to the ankle portion of the boot.

38 Claims, 10 Drawing Sheets

FOOT AND ANKLE ORTHOTIC FOR A SKATE BOOT OR THE LIKE, AND METHOD

CROSS REFERENCE TO RELATED APPLICATIONS

This is a continuation-in-part application of the following U.S. applications:

(a) Ser. No. 06/837/584; filed Mar. 7, 1986; Dennis N. Brown; now U.S. Pat. No. 4,718,179 entitled "ORTHOTIC AND METHOD OF MAKING THE SAME"

(b) Ser. No. 06/899,958; filed Aug. 25, 1986; Dennis N. Brown; now U.S. Pat. No. 4,783,911 entitled "SKATE BOOT ASSEMBLY"

(c) Ser. No. 06/870,123; filed June 3, 1986; Dennis N. Brown; now abandoned entitled "ORTHOTIC INSERT AND METHOD OF MAKING THE SAME".

BACKGROUND OF THE INVENTION

1. Field of the Invention

The present invention relates to a boot assembly, and also a foot and ankle orthotic for use in such a boot assembly. More particularly, the present invention relates to a skate boot assembly where an orthotic insert is used in a particularly advantageous way to properly position and support the foot in the skate boot. Within the broader aspects of the present invention, the book assembly and the orthotic for use therein can be adapted for footware other than skate boots, such as for ski boots, hiking boots, etc., and also in shoes.

2. Background Art

The structuring of a skate boot involves some design considerations that are somewhat different from designing ordinary footware. The base support structure is an elongate quite narrow metal blade that engages the ice surface. Thus, the support force transmitted from the ice is essentially along a single narrow line and this force emanates upwardly from this line contact and also laterally to provide support over a broader area corresponding to the lower surface of the person's foot. The boot should provide proper alignment and balance for the foot and leg.

One type of skate boot is a sewn skate boot. In such skate boots, there is generally a pair of pads, called "L" pads, and these are placed in the rear ankle portion of the boot so as to grip the person's ankle and foot on opposite sides of the Achilles tendon above the heel. It is a relatively expensive manufacturing operation to install such pads in a skate boot. Further, while such pads provide certain benefits, they still must be approximated to fit different foot configurations.

Another consideration is that perspiration from the feet go into these sewn-in pads and other portions of the interior of the boot, and it's somewhat difficult for the moisture to migrate out by the normal processes of evaporation. Thus, the boots sometimes become heavy from an accumulation of moisture.

Another consideration with skate boots in general is that a skater generally wants a certain amount of rigidity in the skates around the ankle so that proper support is provided. On the other hand, when the skater is breaking in a new pair of skates, the rigidity makes this break-in period more difficult. Thus, it is a desirable end to provide such rigidity in a manner that it still permits localized flexibility to make the skate boot more comfortable.

With regard to the general subjects of footware, it has long been known that in many instances the operation of the foot can be improved by use of a proper orthotic. Quite often, the orthotic is in the form of an insert which can be placed in an existing shoe. An orthotic insert can be either soft or hard and also can vary between these extremes. A hard insert is a substantially rigid member, desirably having a relatively thin vertical thickness dimension and extending from calcaneus area of the foot (the heel portion) to at least the metatarsal head area of the foot (i.e., that area of the "ball" of the foot). In general, the purpose of a rigid orthotic (sometimes called a functional orthotic) is to first position, and then to control the movements of, the subtalar and midtarsal joints during the gait cycle which the body goes through in walking and running, or most other weight bearing activities.

However, the gait cycle which a person goes through in walking or running is somewhat different from the cycle which the person's foot goes through when ice skating. Thus, in providing an orthotic for ice skating, while there are many consideration that are common to providing an orthotic insert designed for walking and running, there are, however, some special considerations for the ice skating motion. Further, to the best knowledge of the applicant, many of the design approaches for a skate boot undertaken in the prior art have failed to appreciate the relationship of the dynamics of the foot in the skating motion, relative to the overall structure and operation of the skate boot.

With regard to boots in general (and also with regard to footware other than boots), some of the considerations noted above are applicable. Further, there is the general problem in footware to properly position and support the entire lower portion of the leg (including the foot and ankle). Thus, while the present invention is particularly adapted to be used in a skate boot assembly, and more broadly in boot assemblies in general, certain aspects of the present invention are applicable to other types of footware.

A search of the patent literature had disclosed a number of boot and shoe related devices. These are as follows.

U.S Pat. No. 4,435,456—Livernois et al discloses a lining component which extends around the back and both sides of the foot. This lining component 20 is made of three layers, namely an inner layer which is intended for contact with the wearer's foot and made of an air impervious fabric, an intermediate cushioning layer 24 which is formed by a resilient cushioning material, and an outer layer. Pads 28 are provided, and these are secured to the outer liner by a high frequency welding press. The patent states that the padding is to protect the heel and ankle area. The lining 20 is placed into the boot upper 40 and is permanently bonded thereto by use of an adhesive.

U.S. Pat. No. 4,338,734—Schwartz, shows what is called a "universal orthotic", and this is representative of one type of orthotic which engages the plantar surface of the foot.

U.S. Pat. No. 3,977,098—Chalmers, shows a liner for a ski boot or a skate boot, the side portions of the liner being formed with pockets, which, as can be seen in FIG. 2, are defined b the outline of the stitching 28. The pockets have slits 30 which can be closed by a strip 32, and pads of a selected width, indicate at 34 and 36 can be placed in the pockets. Thus, the liner can accommodate for various widths of the person's foot. This enables the retailer to use one size of the ski boot to accommodate different foot sized within a certain range.

U.S. Pat. No. 3,858,337—Vogel shows a ski boot having a lining which can be detached from the ski boot. Patentability is predicated upon the use of detachable fitting parts which can be secured to the liner by means of an adhesive.

U.S. Pat. No. 3,401,006—Vogel showing a reinforcing member for footware. In FIGS. 1–3 there is an upper ankle portion which is mounted about pivot pins 8. The axis of the pins 8 approximately coincides with the pivot axis of the wearer's ankle. Thus, the hinged connections of the two portions 6 and 7 of the stiffening insert permits unrestricted flexing of the leg at the ankle in a forward and backward direction, while restraining lateral movement.

U.S. Pat. No. 3,333,353—Garcis discloses what is called "a combined insole waist and heel stiffener used in the manufacture of boots, shoes, and light footware". This is fitted in the shoe and made a permanent part thereof.

U.S. Pat. No. 2,617,207—Jennett shows what is called a "tendon protector" which is fastened to the rear outside of the skate boot.

U.S. Pat. No. 2,211,822—Jennings shows another type of tendon protector built up of strips of stiff material held in the heel of the skate boot.

U.S. Pat. No. 252,626—Schenck, shows a combined insole and heel protector that can be made from a single blank. There is a sole portion and an upwardly extending heel protecting portion.

U.S. Pat. No. 225,016—Marggraf shows what is called a "combined counter-stiffener and insole for rubber boots". There is a coarse sole b and an upstanding rear portion or tongue a. The purpose is to prevent the wearing away of the material on the inside of the rubber boot.

U.S. Pat. No. 81,690—Savoy discloses a shoe sole and heel insert that is made of metal.

SUMMARY OF THE INVENTION

The present invention relates to a boot and orthotic assembly, and also to an orthotic adapted for use in such an assembly. It is to be understood that as used herein, the term "boot" is, within the broader scope of the present invention, intended to apply to footwear which technically may not be considered a "boot" as that term is usually understood.

In this assembly, there is a boot comprising a sole with an upper surface adapted to support a plantar surface of a foot, and also comprising an upstanding ankle portion adapted to operatively engage rear and side heel and ankle portions of the foot.

The orthotic insert of the present invention is adapted to be removably positioned within the boot. This orthotic insert comprises:

1. an orthotic foot portion adapted to overlie the sole of the boot and to engage the plantar surface of the foot to properly position the foot;
2. an orthotic ankle portion adapted to be positioned adjacent to the ankle portion of the boot.

The orthotic ankle portion has two inwardly protruding areas which are positioned to snugly engage a person's two lower recessed ankle regions on opposite sides of an Achilles tendon of the person and above the person's lower rear heel region. Further, the orthotic insert and the boot have releasable interconnecting means by which the orthotic insert can be releasably secured to the boot the restrain upward movement of the orthotic ankle portion relative to the ankle portion of the boot.

Thus, when the orthotic insert is positioned in the boot, with the interconnecting means securing the orthotic insert to the boot, the inward protruding areas engage the person's recessed ankle regions, and upward movement of the person's heel and ankle portions relative to the ankle portion of the boot is restrained. Further, since the orthotic insert is removable, it can be manufactured more economically as a separate insert. Further, with the insert being removable, it can more readily be custom fit and adapted to fit the contours of the person's foot.

In the preferred form, the releasable interconnection is made between the orthotic ankle portion and the ankle portion of the boot. These can be first and second connecting members positioned on adjacent surface portions of the orthotic ankle portion and the ankle portion of the boot, so as to releasable engage one another. In one embodiment, there is a Velcro-like member which engages a second member which is connectably compatible with the Velcro-like member.

In another arrangement, the releasable interconnecting means comprises first means which defines a recess in the ankle portion of the boot, and an interconnecting portion of the orthotic ankle portion which is received in the recess. In a preferred configuration, this recess is formed as a downwardly extending recess, and an upper edge portion of the orthotic ankle portion extends into the recess.

In another arrangement, the orthotic foot portions are interconnected by a position adjustable interconnecting means which permits the orthotic ankle portion to be vertically adjusted relative to the orthotic foot portion. Thus, the orthotic ankle portion can be connected to the ankle portion of the boot at different vertical positions of the orthotic ankle portion.

In some embodiments, the orthotic foot portion comprises an upper relatively yielding orthotic foot section and a lower relatively rigid orthotic foot section, with these sections having interfitting protrusion and recess means which interengage to restrict relative movement between the two. In a preferred form, the upper orthotic foot section has a plurality of downwardly extending protrusions which fit in recesses formed by matching downwardly extending protrusions of the lower orthotic foot portion. These lower protrusions can function to stabilize the heel portion of the foot with regard to angular positioning of the heel portion of the foot.

Also, in several preferred embodiments, the orthotic ankle portion comprises a forward relatively yielding orthotic ankle section, and an adjacent rear relatively rigid orthotic ankle section, with these two sections interengaging one another. In a preferred form, the rear orthotic ankle section has an operative interconnection with the lower orthotic foot section which permits at least limited angular movement forwardly and rearwardly of the rear rigid orthotic ankle section. In at least one exemplary embodiment, the rear orthotic ankle section is provided with opening means and the interconnecting means comprises at least one connecting member extending through the opening means to interconnect the forward orthotic ankle section with the ankle portion of the boots.

In another arrangement, the forward and rear orthotic ankle sections have vertically adjustable interfitting recess and protrusion connecting means permitting the forward and rear orthotic ankle sections to be connected to one another at varying relative vertical locations.

The orthotic insert of the present invention has characteristics noted above and is arranged to be used in the boot and orthotic assembly.

Other features of the present invention will become apparent from the following detailed description.

DESCRIPTION OF THE PREFERRED EMBODIMENTS

It is believed that a clearer understanding of the present invention will be achieved by first discussing generally some background information: (a) the main components or parts of the human leg and foot and how these function relative to one another; (b) the gait cycle which a person goes through in a normal walking motion; and (c) the intended function of a rigid orthotic in optimizing the coordinated operation of the person's foot and leg throughout the gait cycle. Following this, there will be a discussion of the cycle which the person goes through in the normal ice skating motion, and the dynamics of the foot during this cycle, after which the skate boot assembly of the present invention will be described.

For convenience, these various topics will be discussed under appropriate subheadings.

Figure 1:
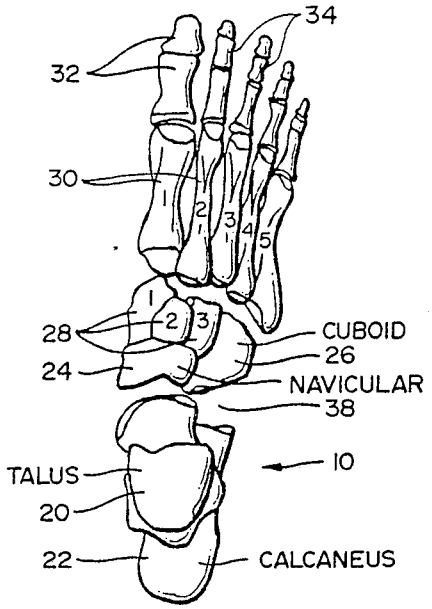
FIG. 1 is a top plan view of the right foot of a human, with certain components of the foot being separated from one another for purposes of illustration.
Figure 2:
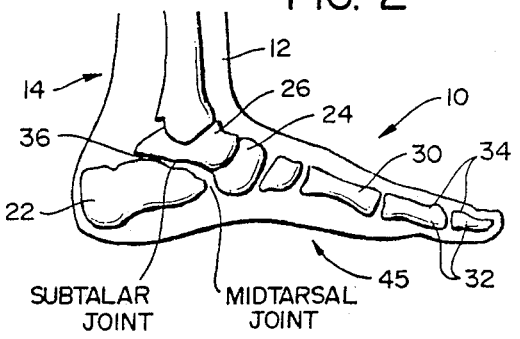
FIG. 2 is a side elevational view looking toward the inside of a person's left foot, and showing certain components of the person's foot.
Figure 3:
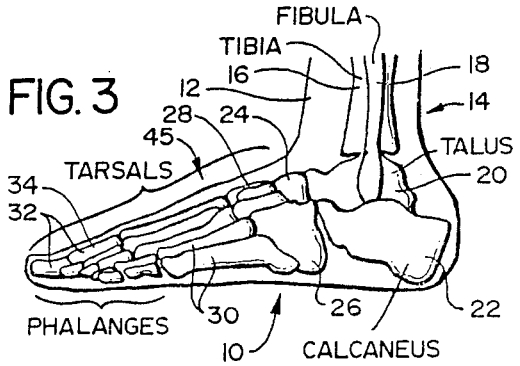
FIG. 3 is a view similar to FIG. 2, but looking toward the outside of the person's foot.

(a) The Main Components or Parts of the Human Leg and Foot and How These Function Relative to One Another With reference to FIGS. 1—3, there is shown a typical human foot 10, and (in FIGS. 2 and 3) the lower part 12 of the leg 14. The two lower bones of the leg 14 are the tibia 16 and fibula 18. Below the tibia 16 and fibula 18, there is the talus 20 (i.e., the "ankle bone"). Positioned below and rearwardly of the talus 20 is the calcaneus 22 (i.e., the heel bone). Positioned moderately below and forward of the talus 20 are the navicular 24 and the cuboid 26. Extending forwardly from the navicular 24 are the three cuneform bones 28. Extending forwardly from the cuneform bones 28 and from the cuboid 26 are the five metatarsals 30. Forwardly of the metatarsals 30 are the phalanges 32 which make up the five toes 34.

The movement of the talus 20 relative to the tibia 16 and fibula 18 is such that it primarily enables the entire foot to be articulated upwardly and downwardly (in the motion of raising or lowering the forward part of the foot). The talus 20 is connected to the tibia 16 and fibula 18 in such a way that when the entire leg 14 is rotated about its vertical axis (i.e., the axis extending the length of the leg), the talus 20 rotates with the leg 14.

With regard to the relationship of the talus 20 to the calcaneus 22, these move relative to one another about what is called the "subtalar joint" indicated at 36. The subtalar joint 36 can be described generally as a hinge joint about which the talus 20 and calcaneus 22 articulate relative to one another. The hinge axis extends upwardly and forwardly at an angle of about 42 degrees from the horizontal, and also slants forwardly and inwardly at a moderate angle (e.g., about 16 degrees from a straightforward direction).

Figure 4A:
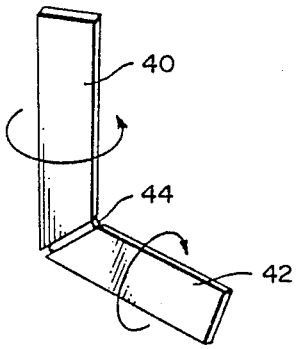
FIGS. 4*a* and 4*b* are perspective views illustrating schematically the rotational movements of the talus and calcaneus about the subtalar joint or in a more gross sense the rotation of the leg on the foot at the subtalar joint.
Figure 4B:
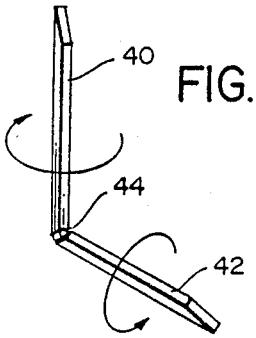

To explain further the hinge motion of the subtalar joint 36, reference is now made to FIGS. 4*a* and 4*b*. The talus 20 and leg can be considered as a vertical board 40, and the calcaneus 22 and the remainder of the foot, but not including the talus, as a horizontally extending board 42, these being hinge connected to one another along a diagonal hinge line 44, with this hinge line corresponding to the subtalar joint 36. It can be see with reference to FIG. 4*a* that as the talus 20 and leg are rotated inwardly about its vertical axis (i.e., the front part of the leg being rotated toward the center of the person's body), there is a corresponding rotation of the calcaneus 22 and foot (i.e., the horizontal board 42) about a horizontal axis. These motions are associated with the pronation of the subtalar joint. It can be seen in FIG. 4*b* that an opposite (i.e., outward) rotation of the talus 20 and leg (i.e., the vertical board 40) causes a corresponding rotation of the calcaneus 22 and foot (i.e., the horizontal board 42). These motions are associated with the supination of the subtalar joint and are in the opposite direction from that shown in FIG. 4*a*.

This motion described with reference to FIGS. 4A and 4*b* above is critical in the gait cycle (i.e., the cycle through which the person goes in normal walking or running motion), and this will be discussed more fully below.

It is important to note that the position of the coleoneus relative to the floor is directly influenced by the position of the subtalar joint. As the subtalar joint supinates the calcaneus inverts and conversely as the subtalar pronates the calcaneus everts.

With regard to the midtarsal joint 38, this is in reality composed of two separate joints, the talo-navicular and the calcaneal-cuboid. It is a complex joint, and no attempt will be made to illustrate or recreate its motion accurately. Instead, there will be presented a somewhat simplified explanation of its function as it relates to the present invention.

The main concern, relative to the midtarsal joint, is not the precise relative motion of the ports of the foot that make up this joint, but rather the locking and unlocking mechanism of the midtarsal joint which occurs when there is an outward motion of the leg 14 and the talus 20 (outward motion meaning the rotation of the leg 14 and foot 10 about the vertical axis of the leg 14 in a manner that the knee moves outwardly from the person's body), and an opposite inward motion, respectively. When the leg 14 rotates inwardly so that the subtalar joint pronates, the midtarsal joint 38 unlocks so that the portion of the foot 10 forwardly of the joint 38 (i.e., the midfoot 45) is flexible, this being the "pronated" position of the foot. On the other hand, when the leg 14 and talus 20 rotate outwardly so that the subtalar supinates, the foot is said to be "supinated" so that the midtarsal joint 38 is locked and the midfoot 45 essentially becomes a part of a rigid lever. In actuality, the midfoot 45 never becomes totally rigid, so that even in the totally supinated position, there is some degree of flexibility in the midfoot 45.

Figure 5A:
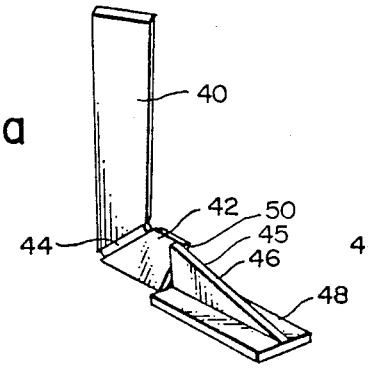
FIGS. 5*a* and 5*b* are schematic views similar to those of FIG. 4*a–b*, but further illustrating the relative movement between the calcaneus and the midfoot about the midtarsal joint.
Figure 5B:
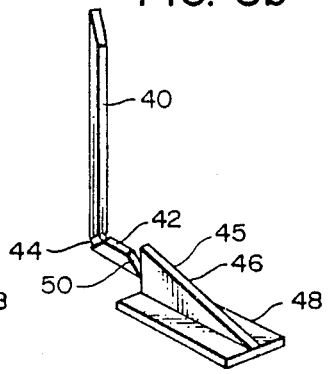

This function of the midtarsal joint will now be explained relative to FIGS. 5*a* and 5*b*. It can be seen that FIGS. 5*a–b* are generally the same as FIGS. 4*a–b*, except that a forward board member 46 is shown to represent the midfoot 45, this member 46 having a downward taper in a forward direction, and also a lower horizontal plate portion 48. This plate portion 48 is intended to represent that the plantar surface (i.e., the lower support surface) of the midfoot 45 engages the underlying support surface in a manner so as to remain generally horizontal to the support surface.

It can be seen that when the two board members 40 and 42 are in the pronated position of FIG. 5*a–b* is in a first position which will be presumed to be an unlocked position. In the unlocked position of FIG. 5*a*, the member 46 is not rigid with the horizontal member 42, and the forward member 46 can rotate and/or flex relative to the horizontal member 42. (This is the pronated position of the foot 10.) However, in the position of FIG.

5b, the board members 46 and 42 will be presumed to be locked to one another so that the members 42 and 46 form a unitary lever. For ease of illustration, no attempt has been made to illustrate physically the unlocking relationship of FIG. 5a and the locking relationship of FIG. 5b. Rather the illustrations of FIGS. 5a–b are show the relative movement of these components, and the locking and unlocking mechanism is presumed to exist.

(b) The Gate Cycle Which the Person Goes Through is a Normal Walking Motion

Figure 6A:
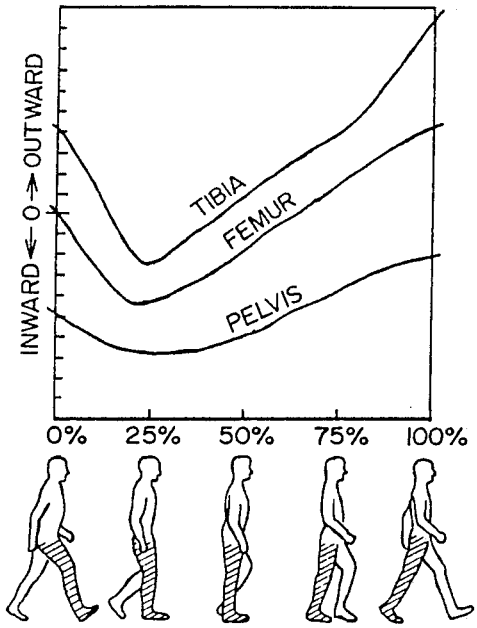
FIG. 6*a* is a graph illustrating the rotational movement of the pelvis, femur and tibia during the gait cycle of the right limb.
Figure 6B:
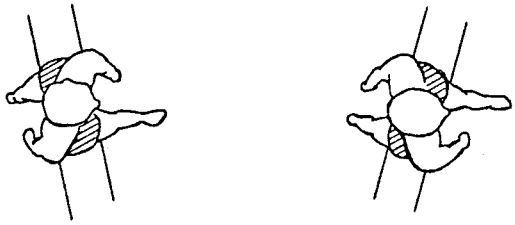
FIG. 6*b* is a top plan view illustrating the rotation of the person's pelvis during that portion of the gait cycle illustrated in FIG. 7*a;*

Reference is first made to FIGS. 6a and 6b. As illustrated in the graph of FIG. 6a, during the normal walking motion, the hip (i.e., the pelvis) moves on a transverse plane, and this movement in the gait cycle is illustrated in FIG. 6b. Also, the femur (i.e., the leg bone between the knee joint and the hip) and the tibia rotate about an axis parallel to the length of the person's leg. (It is this rotation of the leg about its vertical axis which in large part causes the pronating and supinating of the foot during the gait cycle, and this will be explained in more detail below.)

There is also the flexing the extension of the knee, as illustrated in the five figures immediately below the graph of FIG. 6a. Further, there is a flexing and extension of the ankle joint. At the beginning of the gait cycle, the heel of the forwardly positioned leg strikes the ground, after which the forward part of the foot rotates downwardly into ground engagement. After the leg continues through its walking motion to extend rearwardly during the gait cycle, the person pushes off from the ball of the foot as the other leg comes into ground engagement.

The motions described above are in large part generally apparent to a relatively casual observation of a person walking. However, the motion which is generally overlooked by those not familiar with the gait cycle is the inward and outward rotation of the leg about its lengthwise axis to cause the pronating and supinating of the foot through the gait cycle. This will be described relative to FIG. 7a and FIG. 7b.

When the leg is swung forwardly and makes initial ground contact, at the moment of ground contact the leg is rotated slightly to the outside (i.e., the knee of the leg is at a more outward position away from the center line of the body) so that the foot is more toward the supinated position (i.e., closer to the position shown in FIG. 4b). However, as the person moves further through the gait cycle toward the 25% position shown in FIG. 7a, the leg rotates about its vertical axis in a an inside direction so that the subtalar joint is pronating. The effect of this is to rotate the heel of the foot so that the point of pressure or contact moves from an outside rear heel location (shown at 52 in FIG. 7b) toward a location indicated at 54 in FIG. 7b. As viewed from behind, this same motion causes the calcaneus to evert. This pronating of the subtalar joint 36 produces a degree of relaxation of the midtarsal joint 38 and subsequent relaxation of the other stabilization mechanisms within the area of the foot. This reduces the potential shock that would otherwise be imparted to both the foot and the lower extremity because the joints of the rear foot are functioning as torque translators.

Figure 7A:
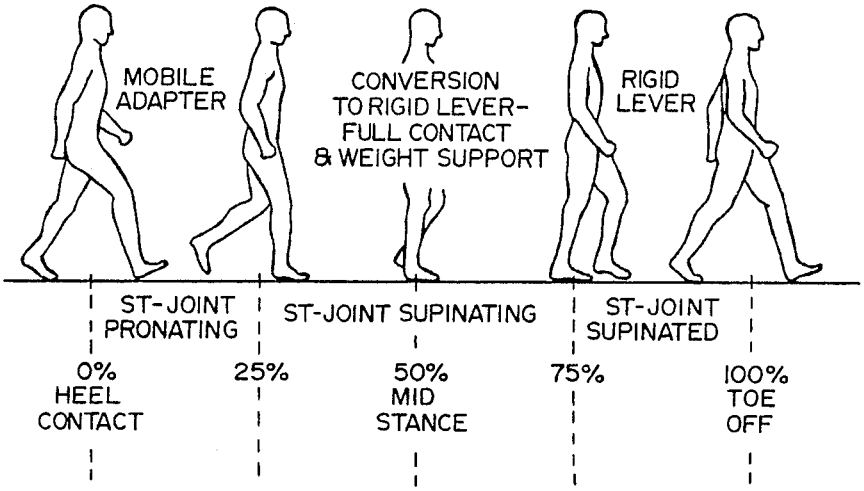
FIG. 7*a* is a graph similar to FIG. 6*a*, but illustrating the timing of the pronating and supinating motion of the foot relative to the leg through the gait cycle of the right limb and foot.
Figure 7B:
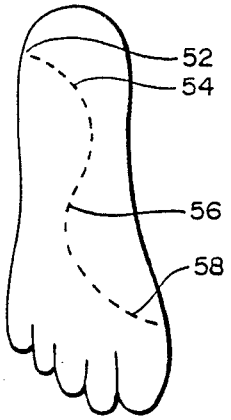
FIG. 7*b* is a view looking upwardly toward the plantar surface of a person's left foot, and illustrating the distribution or location of the center of pressure throughout the period of ground contact of the portion of the gait cycle illustrated in FIGS. 6*a* and 7*a;*

With further movement from the 25% to the 75% position, the leg rotates in an opposite direction (i.e., to the outside) so that the subtalar joint 36 becomes supinated by the 75% location of FIG. 7a. As the subtalar joint undergoes this supinatory motion the calcaneus inverts. This locks the midtarsal joint 38 so that the person is then able to operate his or her foot as a rigid lever so as to raise up onto the ball of the foot in a more stable position and push off as the other leg moves into ground contact at a more forward location.

With reference again to FIG. 7b, the initial pressure at ground contact is at 52 and moves laterally across the heel to the location at 54. Thereafter, the pressure center moves rather quickly along the broken line indicated at 56 toward the ball of the foot. As the person pushes off from the ball of the foot and then to some extent from the toes of the foot, the center of pressure moves to the location at 58.

(c) The Intended Function of the Orthotic to Improve Operation of the Person's Foot and Leg Throughout the gate Cycle If the person's foot were perfectly formed, then there would be no need for an orthotic device. However, the feet of most people deviate from the ideal. Accordingly, the function of the orthotic is first to position the plantar surface of the calcaneus 22 and the midfoot 45 so that the subtalar and midtarsal joints 36 and 38 are initially positioned properly, and to thus control the subsequent motion of the foot parts or components that make up these joints so that the movements of the hip, leg and foot throughout the gait cycle are properly accomplished. Also proper positioning of the foot and subtalar joint affects the positioning of the calcaneus relative to the supporting surface. It can be readily understood that if the component of the foot have the proper initial position and movement about the subtalar midtarsal joints 36 and 38, the entire gait cycle, all the way from the coordinated rotation of the hips through the flexing and rotation of the hips through the flexing and rotation of the leg, and also through the initial strike of the heel on the ground to the final push off from the toe of the foot, is properly coordinated and balanced for optimum movement.

Since shoes are generally manufactured on a mass production basis, the supporting surface of the interior of the shoe may or may not optimally locate the plantar surface of the foot. Accordingly, it has for many years been a practice to provide an orthotic insert which fits within the shoe to optimize the locations of the foot components. In general, these inserts have been made of various materials, some of which are formed as laminated structures and some as rigid thermoplastic to provide a relatively rigid support for the heel and midfoot regions of the foot.

These orthotics can be formed in a variety of ways. One preferred method of forming an orthotic insert is described in the applicant's U.S. Pat. No. 3,995,002. In that method, there is formed a negative mold or slipper cast from which a positive cast of the plantar surface of the individual's foot is formed. Using this positive cast as a template, an orthotic insert is formed to underlie an area under the foot. The inset itself is fabricated by applying to the positive cast the material which is to be the orthotic insert. The precise configuration of the insert will depend upon the prescribed corrective measures to be taken for the individual's foot.

Figure 26:
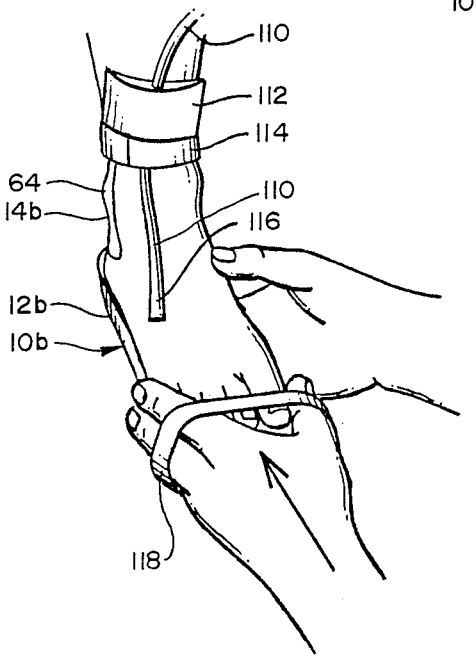
FIG. 26 through 31 are isometric view illustrating the manner in which an orthotic of the present invention can be fitted to a person's foot.
Figure 27:
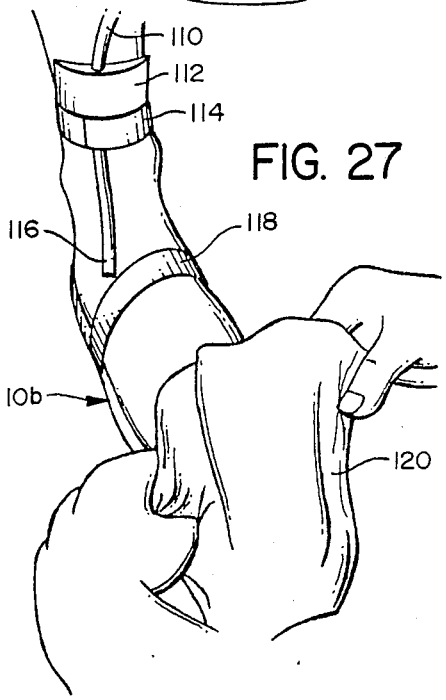
Figure 28:
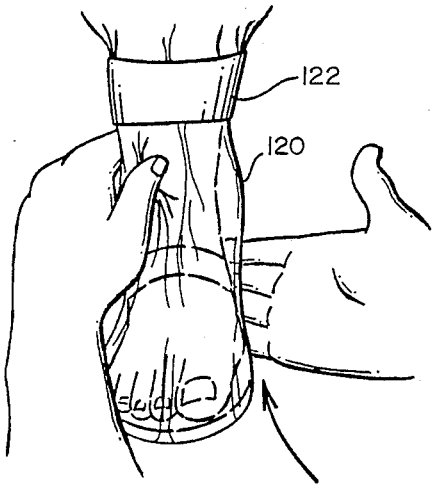
Figure 29:
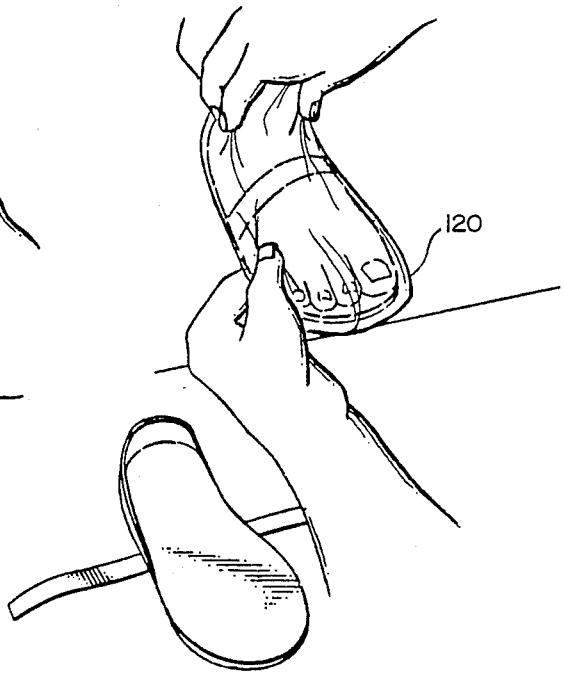
Figure 30:
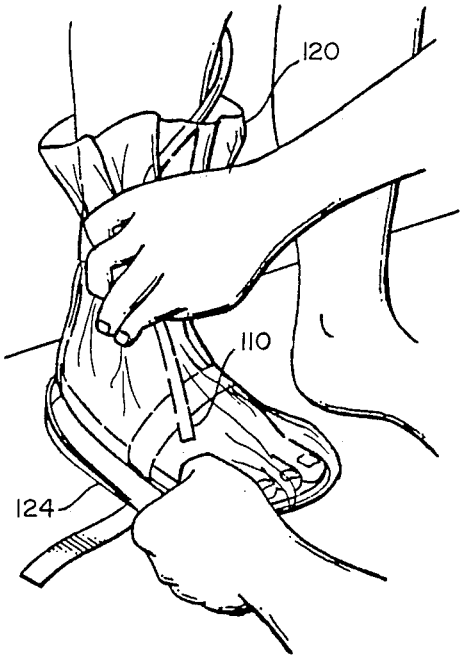
Figure 31:
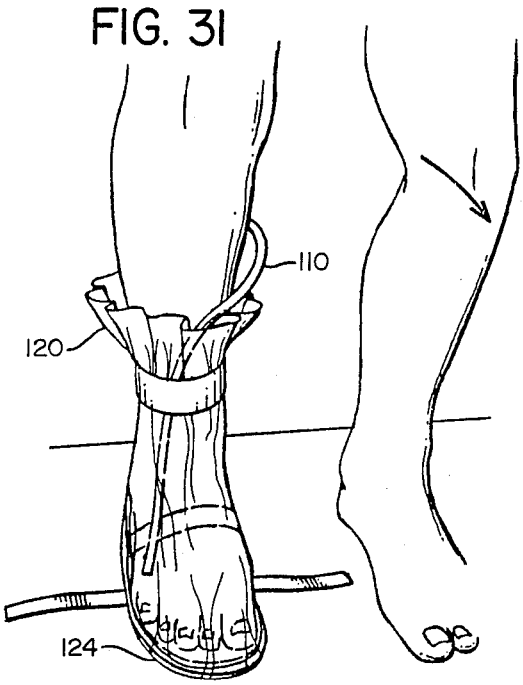

Another preferred method of forming an orthotic insert is illustrated in the applicant's co-pending patent application, U.S. Ser. No. 06/837,584, filed Mar. 7, 1986, entitled "ORTHOTIC AND METHOD OF MAKING THE SAME". The method described in the present invention, with reference to FIGS. 26 through 28, is quite similar to that described more fully later herein. Yet another method is described in the applicant's co-pending patent application U.S. Ser. No. 06/870,123, filed June 3, 1986, entitled "ORTHOTIC INSERT AND METHOD OF MAKING THE SAME", and the method described with reference to FIGS. 29 through 31 is quite similar to what is described in U.S. patent application Ser. No. 06/870,123.

(d) The Cycle of Movement for Ice Skating

While the present invention is not limited to use in ice skates, it is believed that there are certain characteristics of the present invention which make it well adapted to being incorporated in ice skates. Accordingly, it is believed that a greater appreciation of the present invention will be achieved by discussing the cycle of movement for ice skating.

Skating is not an inate method of human locomotion, and it requires both special skill and unique equipment. Nevertheless, it is a weight bearing sport, and it is greatly affected by the stability and performance of the foot. The operating cycle which the person's body goes through in performing the ice skating motion has certain similarities to the gait cycle described above, but there are some important differences. It is believed that the prior art approaches of which the applicant is aware, relative to the design of skate boots and their associated components, have failed to appreciate the significance of these differences.

With regard to the similarities between the support provided by ice skates and conventional shoes, there is substantial similarity when the person is in a standing position, very little muscular activity is required for balance. Whether the person is in skates or shoes, when the body leans forward, the calf (gastrocnemius) muscles push the forfoot into the supporting surface (ice). Since the ice is rigid and immovable, the net effect is to pull the body backward. Conversely, if the body leans too far backwards, the anterior tibial muscle contracts to pull the body forward. This mechanism keeps the body stable and over the center of gravity.

Like walking, ice skating is characterized by a period of double support and a period of single support. The double support period is the propulsive phase, while the single support period is a gliding phase. Propulsion begins immediately after the non-supporting skate is placed in contact with the ice in proper alignment. At this time, the trailing leg is externally rotated so that the skate faces outwardly (externally) relative to the plane of progression while the hip and knee extend. The primary accelerating force is the explosive extension of the knee. Because the forces generated in the knee reach a peak velocity before the knee is fully extended, the skate is lifted from the ice prior to full extension of the knee. Normally, the ankle joint does not plantarflex (extend) and therefore does not contribute to the propulsion. The propulsive forces generated by the rapid knee extension are transmitted to the ice through the outwardly facing skate.

Figure 8:
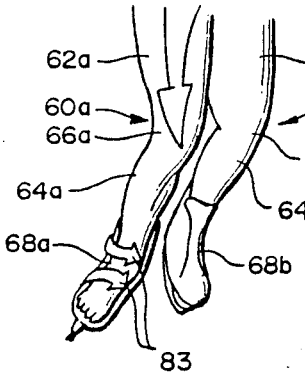
FIG. 8 is a front elevational view of the legs and ice skates of a skater, showing the skater turning to his left and beginning the propulsive phase of the skating cycle, but with the right foot pronating and without use of the present invention.
Figure 9:
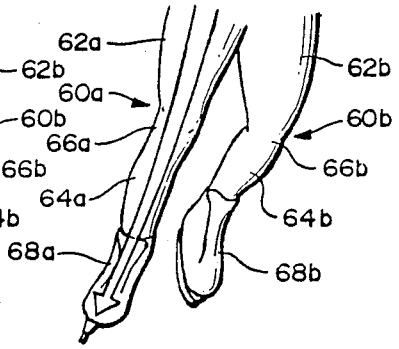
FIG. 9 is a view similar to FIG. 8, illustrating the skater in the same situation as in FIG. 8, but with a pair of skates incorporating the present invention, and with the feet properly positioned.

In FIGS. 8 and 9, there is shown a person's right and left leg 60*a* and 60*b*, respectively, with the legs comprising the thigh 62*a* and 62*b*, the calf 64*a* and 64*b*, and the knee 66*a* and 66*b*, respectively. The right and left boots are designated 68*a* and 68*b*, respectively. In both FIGS. 8 and 9, the skater is turning to his left, with the right leg and skate beginning the propulsive phase, as soon as the left skate 68*b* contacts the ice and commences gliding. FIG. 8 illustrates a situation where the leg and the components of the foot are positioned so that the subtalar joint is pronated and the midtarsal joint is unlocked. In FIG. 9, the right leg 60*a* and the components of the foot are positioned so that the subtalar joint is neutral and the midtarsal joint is locked. The situation of FIG. 8 could occur where the skate boot of the present invention is not used, and the situation of FIG. 9 would occur under circumstances where the skate boot of the present invention is used. This will be discussed more fully later herein, but first, we will analyze more basic considerations relating to the basic skating motion.

Figure 10A:
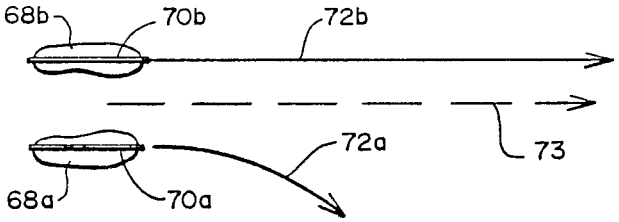
FIG. 10*a* is a schematic top plan view illustrating the path of the skates during a portion of the skating cycle.

This motion is illustrated somewhat schematically in FIG. 10*a*. The right boot 68*a* is shown at the completion of the glide portion of the cycle, and is about to move into the propulsive phase. More particularly, the blade 70*a* of the right boot 68*a* is initially aligned substantially straight ahead along the path of motion, and as the right leg 60*a* moves into the propulsive phase, the right leg is rotated so that the blade 70*a* follows a curved path 72*a* slanting further outwardly to the right. As the blade 70*a* moves further into this curved path 72*a*, the skater pushes off from the right leg 60*a* to generate the propulsive force, which is indicated somewhat schematically by the dotted arrow 73 representing the center of gravity of the superimposed torso of the skater.

With regard to the left boot 68*b*, since this is just entering the glide phase, the blade 70*b* is following a path 72*b* which remains substantially straight ahead. When the right leg 60*a* has completed the propulsive phase, then the right leg 60*a* is moved back to a location more directly beneath the person's body and in more straight ahead alignment for this glide phase, with the left leg 60*b* then beginning its propulsive phase so as to follow a curved outward path.

Figure 10B:
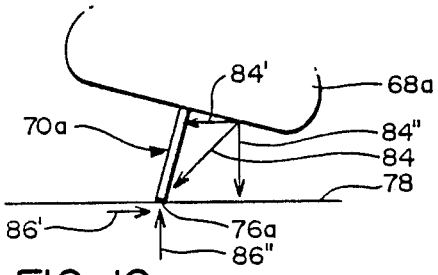
FIG. 10*b* is a schematic view showing a skate boot engaging an ice surface during the propulsion phase, and illustrating a certain application of the force components exerted from the boot to the ice surface.

It is important to consider the manner in which the forces are transmitted from the foot through the boot and through the blade to the ice. Reference is made to FIG. 10*b*, where the right boot 68*a* is shown in its propulsive phase, with the lower edge 76*a* of the blade 70*a* contacting the ice surface 78 at an angle. The thrust forces exerted from the foot are not, during the propulsive phase, spread uniformly across the plantar surface of the foot (i.e., the lower surface). Rather, the thrust forces are transmitted through the medial (inside) of the foot and skate to the supporting surface. The prime mechanism of weight bearing along the medial or "inside" of the foot is the first ray (see FIG. 1), which comprises the first cunieform 28(1), the first metatarsal 30(1) and the great toe 32(1). Efficient transmission of the accelerating forces and of body weight to the boot and thence to the ice surface can only be accomplished if the bony segment is stable.

Figure 11:
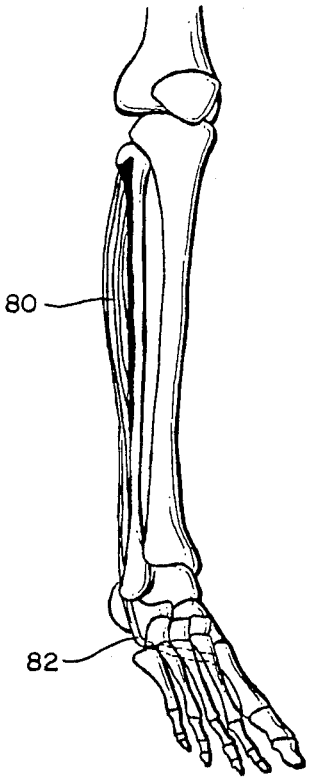
FIG. 11 is an isometric view showing a portion of the person's right leg, and illustrating the Peroneous Longus muscle.
Figure 12:
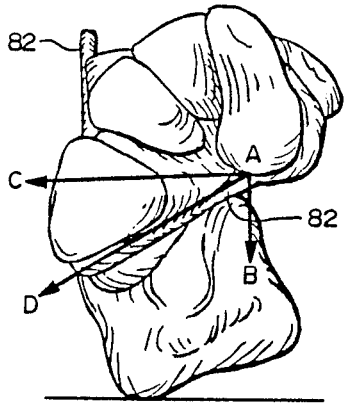
FIG. 12 is a front elevational view of a portion of a person's foot, illustrating the action of the Peroneous Longus tendon where the foot is supinated.
Figure 13:
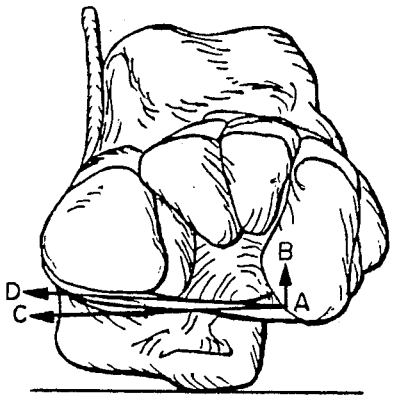
FIG. 13 is a view similar to FIG. 12, illustrating the action of the Peroneous Longus muscle where the foot is pronated.
Figure 14:
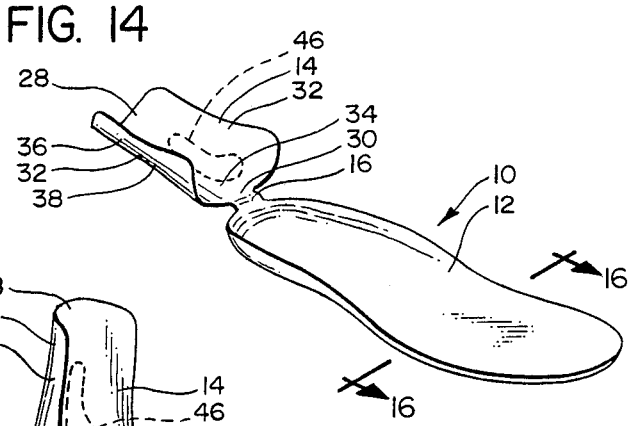
FIG. 14 is an isometric view of a first embodiment of the foot/ankle orthotic of the present invention, with the foot and ankle portions of the orthotic being generally aligned in a common plane.
Figure 15:
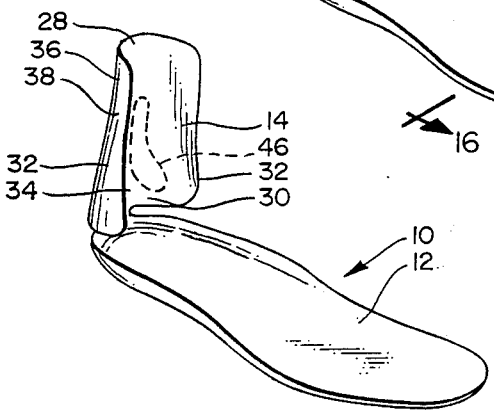
FIG. 15 is a view similar to FIG. 14, but showing the ankle portion of the orthotic vertically positioned to engage a rear ankle portion of the person's foot.

This stability is dependent upon two factors: a locked (stable) midtarsal joint and contraction of the Peroneus Longus (shown at 80 in FIG. 11). With reference also to FIG. 12 and 13, the Peroneus Longus tendon 82 extends downwardly along the outside rear portion of the foot, and then beneath the foot in a forward and inward direction to connect to the first ray. When the subtalar joint is supinated or neutral (as shown in FIG. 12), contraction of the Peroneus Longus muscle produces a force indicated at AD, which in turn produces a strong plantar flexion vector force (indicated at AB).

However, when the subtalar joint is in a pronated position (as in FIG. 13), contraction of the Peroneus Longus muscle produces a force along the first ray in the direction of abduction (arrow AC) but exerts no significant plantar flexion force along the first ray. When the Peroneus Longus muscle is unable to exert an adequate plantar flexion force along the base of the first ray, ground reaction forces directed upwardly against the head of the first metatarsal will create an unstable state of the first ray, and thus degrade the ability of the medial portion of the foot (i.e., the inside of the foot) to transmit from the leg the proper propulsive force into the boot and thence to the blade.

Thus, it becomes apparent that the proper position and internal alignment of the foot are significant factors in the efficiency of skating. Further, it becomes apparent from an examination of FIG. 10 that the ability of the foot to align the underlying blade of the skate boot very accurately, both for the glide phase and the propulsive phase, is critical for properly accomplishing the skating motion.

To explain this further, when the subtalar joint is pronated, the midtarsal joint is unstable and the first ray excessively mobile. To a skater, this translates into a less firm base of support stance, in that the foot remains a mobile adaptor, rather than a rigid lever. In addition, the first ray is excessively mobile and therefore contraction of the Peroneus Longus muscle cannot efficiently stabilize the first ray. This leads to a less efficient forward thrust since this propulsive mechanism is not stable (i.e., excessively mobile), and therefore the generated acceleration forces cannot be effectively transmitted to the ice.

The pronated foot presents an additional complication to skating. Pronation of the rearfoot and unlocking of the midtarsal joint change the internal architecture or alignment of the foot such that there is a relative abduction of the forefoot on the rearfoot. In other words, there is a lateral splaying of the forefoot relative to the rear foot. This obviously changes the position of the weight bearing areas of the foot relative to the blade axis of the skate, and these internal changes within the foot have traditionally caused foot problems since the shape of the foot has been altered.

Reference is again made to FIGS. 8 and 9. As indicated earlier, in both FIGS. 8 and 9, the skater is turning to his left, with his right leg 60*a* and skate 68*a* about to begin the propulsive phase as soon as the left skate 68*b* contacts the ice and commences gliding. Note that in FIG. 8 the right leg 60*a* is inwardly rotated and the arch has collapsed and rolled toward the midline of the body, as illustrated by the arrows 83. In such an instance, the subtalar joint is pronated and the midtarsal joint unlocked. From this position, there is a decreased efficiency in the propulsion for three distinct reasons:

a. The Peroneus Longus muscle is incapable of stabilizing the first ray;
b. The major segments of the suprastructure are not centered over the skate blade; and
c. The angle of the blade to the ice is increased (less vertical).

This could occur where the skater is not utilizing the proper orthotic system as described in the present invention.

In FIG. 9 the same skater is shown utilizing the orthotic system of the present system as he rounds the same corner. The right leg 60*a* will begin the propulsive phase as the left skate 68*b* contacts the ice and commences gliding. Note that the right leg 60*a* faces straight forward and the structure of the foot is properly aligned (i.e., the subtalar joint is neutral and the midtarsal joint is locked). From this position, propulsion is more efficient because the Peroneus Longus muscle can stabilize the first ray and lallux for active propulsion. In addition, note that the suptrastructure is aligned more directly over the skate blade (optimizing balance and control).

It is also important to note how the force is transmitted from the foot to the lower edge 76*a* of the blade, and to discuss this further, reference is made again to FIG. 10*b*. Since the medial (i.e., inside) portion of the foot is positioned inside of the blade, as the foot moves into the propulsive phase so that the force imparted from the foot is primarily along the first ray, the force is offset (i.e., directed at a location inside the blade 70*a*).

If the foot is to transmit its propulsive force directly to the underlying ice surface 78, then this force must be directed at the ice engaging blade edge 76*a*. In FIG. 10*b*, the force component exerted by the first ray of the foot is indicated at 84, and it can be seen that this force component 84 is directed to the blade engaging surface 76*a*. For purposes of analysis, this force component can be resolved in two way. First, with reference to FIG. 10*b*, this force component 84 can be considered as having a horizontal component 84' and a vertical force component 84Δ. This is reacted into the ice along two force components, namely a horizontal force component 86' which is equal and opposite to the force component 84', and the vertical force component 86'' which is equal and opposite to the force component 84''.

Figure 10C:
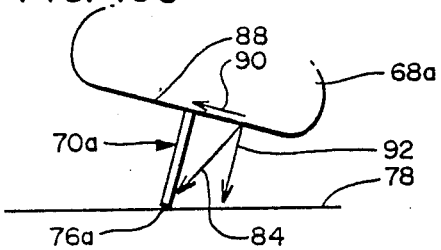
FIG. 10*c* is a view similar to FIG. 10*b*, but showing a different resolution of the force components created by the person's foot pushing against the skate boot.

To analyze these force components yet further, in FIG. 10*c*, let us examine the same force component 84 as it relates to the structure of the boot 68*a*. This boot 68*a* has an upwardly facing bearing surface 88 which engages the plantar surface of the person's foot. It will be noted that the force component 84 is directed onto the boot supporting surface 88 at something of an angle slanted from a line perpendicular to the surface 88. Thus, this force component 84 can also be resolved into a first component 90, which is parallel to the surface of the boot 88, and a second component 92 which is perpendicular to the boot supporting surface 88. This indicates that when the skater is pushing off from the first ray of the foot in the propulsive phase, there is not only a downward force component against the boot surface 88, but also the lateral force component 90.

To compare the skating cycle with the normal gate cycle which the person goes through in walking and running, reference is made to FIG. 7. It can be seen that as the right foot makes contact at the 0% location, as described previously, the knee of the leg is slightly outwardly relative to the center line of the body so that the subtalar joint is more toward the supinated position (i.e., closer to the position shown in FIG. 4*b*). As a person's foot moves toward the 25% position shown in FIG. 7*a*, the leg rotates about its vertical axis in an inside direction so that the subtalar joint is pronating. This leaves the front part of the foot somewhat mobile so that it can adjust itself to the ground contour. When the person is at about midstance, the knee is rotating back outwardly so that the subtalar joint is in a neutral phase, where a moderate amount of further outward rotation of the knee will bring the foot to a position where the midtarsal joint is fully locked, as at the 75% position of FIG. 7.

In the skating cycle, the first half of the gate cycle of FIG. 7 is substantially bypassed. Rather, when the skate boot is brought into contact with the ice surface for the gliding phase, the weight of the person is approximately evenly distributed between the forward and rear portions of the foot. This would correspond approximately to the 50% midstance position of FIG. 7. Then when the person's foot goes into the propulsive phase of the skating cycle, the force of the foot is exerted from the person's foot to the boot at the location of the first metatarsal head (i.e., at the ball of the foot just behind the big toe), with some of the force possibly being exerted from the first phalange 32 (i.e., the big toe).

With the force from the foot being exerted into the boot primarily at the location of the first metatarsal head of the foot which is in the propulsive phase, there is a tendency for the heel portion of that foot to lift upwardly. Yet the blade of the skate in the propulsive phase normally remains in contact with the ice along its entire length so that the force from the foot can be properly transmitted into the ice for pushoff. Further, the foot must be snugly held, relative to the skate boot, so that the foot can accurately position the skate boot to keep the blade in precise alignment. Thus, for example, if the heel portion of the foot were to move, even slightly, upwardly or laterally, some of this precise control would be lost. The same is true when the skate or the foot is in the glide phase. Even though the foot in the glide phase is not pushing off, there still must be that snug engagement between the foot and the skate so that the skate can be kept in proper alignment.

Further, it should be noted that the force exerted by the foot is, as discussed relative to FIGS. 10*b* and 10*c*, exerted not directly downwardly, but also with a laterally outward force component, depending on the angle of the blade to the ice and the stability of the foot within the boot.

Also, as indicated previously, the alignment of the foot relative to the alignment of the skate is, in comparison with the conventional gate cycle in walking and running, more critical.

It is with the foregoing in mind that the skate boot assembly of the present invention was conceived.

The first embodiment of the present invention is illustrated in FIGS. 14 through 18. There is an orthotic insert 10, having a foot portion 12 which is adapted to engage the plantar surface of a person's foot, and a rear ankle portion 14, adapted to engage the rear portion of the ankle. The foot and ankle portion 12 and 14 are joined by a flexible connecting piece 16.

Figure 16:
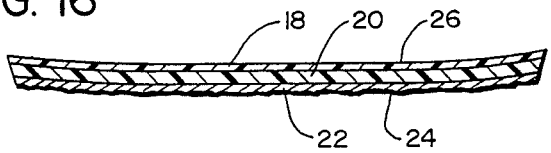
FIG. 16 is a sectional view taken along line 16—16 of FIG. 14.
Figure 17:
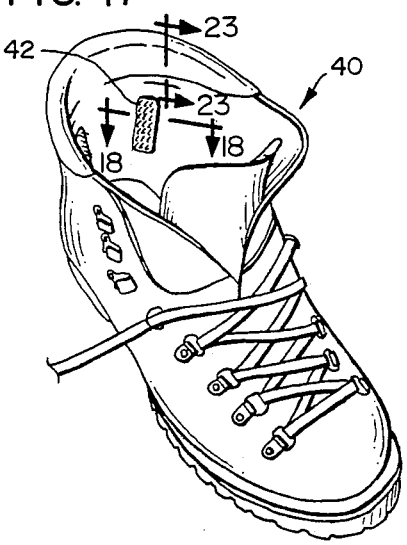
FIG. 17 is an isometric view of a hiking boot adapted to be used in combination with the orthotic shown in FIGS. 14 through 16.

The configuration and structure of the foot portion 12 can be, in and of itself, conventional. As illustrated in FIG. 16, there is an upper layer 18 which is abrasion resistent and is able to absorb perspiration, and this can be made of a cloth material, such as nylon, Dacron, cotton or the like. A second layer 20 is bonded to the lower side of the first layer 18, and this can be made of a yielding closed cell foam material of the appropriate density. If desired, a third lowermost layer 22 could also be added, and this could also be of a foam material, possibly having characteristics differing from the foam material which makes up the second layer 20. The lower surface 24 of the foot portion 12 of the orthotic 10 is contoured to fit the surface of the sole of a conventional boot (either a skate boot or other boot) while the upper surface 26 is contoured to properly position the person's foot. Various improvements could be incorporated in the foot portion 12, some of which are described in patents (and also pending U.S. patent applications), filed in the name of the inventor herein.

The ankle portion 14 has an upper end 28, a lower end 30, side portions 32 and a rear middle portion 34. This ankle portion 14 is positioned and shaped to engage the rear portion of a person's ankle, with the rear middle portion 34 extending from the lower rear part of the heel upwardly along the person's Achilles tendon, and the side portions 32 extending forwardly and laterally outwardly from the middle portion 34.

The rear surface 36 has a layer 38 of a Velcro-compatible material, such as that sold under the trade name "Trico". Such a material is easy to incorporate during the manufacturing process of the orthotic 10, and this "Trico" material is well adapted to releasably engage a Velcro-like material.

The orthotic 10 is adapted to be positioned within a boot, which could be a skate boot, but which in this particular embodiment is shown as a hiking boot 40. This hiking boot 40 can be of conventional design, but in the present invention, it is provided with Velcro strips 42 which are positioned at the rear vertical inner surface of the boot 40 adjacent to, and on opposite sides of, the extreme rear center portion 44 of the boot 40. These Velcro strips 42 releasably engage the Trico layer 38 on the orthotic ankle portion 14.

Figure 18:
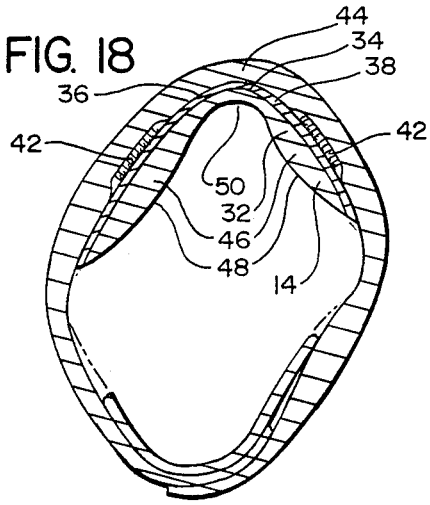
FIG. 18 is a sectional view taken along line 18—18 of FIG. 17, showing the orthotic of FIGS. 14 through 16 inserted in the boot.

As can best be seen in FIG. 18, the side portions 32 of the ankle portion 14 are contoured so as to have thickened "L" or "C" shaped portions 46 whose inner surfaces 48 extend inwardly in something of a convex curve. Also, the protruding portion 46 on one side of the ankle portion 14 is indicated by broken lines in FIGS. 14 and 15, it being understood that the protruding portions 46 are on both sides of the ankle portion 14. As can be seen in FIG. 18, the ankle portion 14 has a rear vertical recess 50 which fits adjacent the person's Achilles tendon, and two moderately protruding portions 46 which are contoured to fit snugly against the rear of the person's ankle on opposite sides of the Achilles tendon, just above the heel, and below and behind the ankle bones.

It is to be understood that the configuration of the protruding portions 46 can vary, as can the material from which these are made. For example, a material which will yield under pressure can be used to conform to the contour of the rear ankle and heel of the person's foot, such a material being Flo-lite (a trademark). Or a semi-rigid cork material, such as Birko cork, can be used, or various types of foam material. Further, combinations of these can be used. Also, the ankle portion 14 of the orthotic can be extended to cover the inside or outside bones or to encircle the ankle.

The orthotic 10 is placed in the boot 40 so that the orthotic foot portion 12 lies on the upper surface of the sole of the boot. The orthotic ankle portion 14 is positioned so that the protruding portions 46 are at the proper height to snugly engage the person's ankle, with the lower part of the protruding portions 46 being positioned snugly against the upper part of the heel that slants inwardly toward the Achilles tendon. This enables the foot to have better rear foot control of the boot. Then the orthotic ankle portion 14 is pressed rearwardly and outwardly so that the Trico layer 38 of the orthotic ankle portion 14 comes into connecting engagement with the Velcro strips 42.

When the person places his or her foot into the boot and laces the boot up, the person's foot is properly positioned by the orthotic foot portion 12, while the person's ankle is snugly engaged by the orthotic ankle portion 14. Upward movement of the person's heel is resisted by the inwardly protruding portions 46 of the orthotic ankle portion 14 engaging the upper rear portion of the person's heel. Further, the person's ankle is comfortably held, with lateral movement of the person's ankle being resisted by the orthotic ankle portion 14. With the connecting piece 16 of the orthotic 10 being relatively flexible, it is a simple matter to position the ankle portion 14 further upwardly or downwardly (or even laterally, if needed) to ensure that there is proper engagement with the person's ankle.

While the foot portion 12 is shown as a full length orthotic member, it is to be understood that this foot portion 12 could be made shorter so as to extend only to the metatarsal area of the person's foot. Further, this orthotic 10 can be replaced rather easily and also removed so that it can be dried or repaired.

Figure 19:
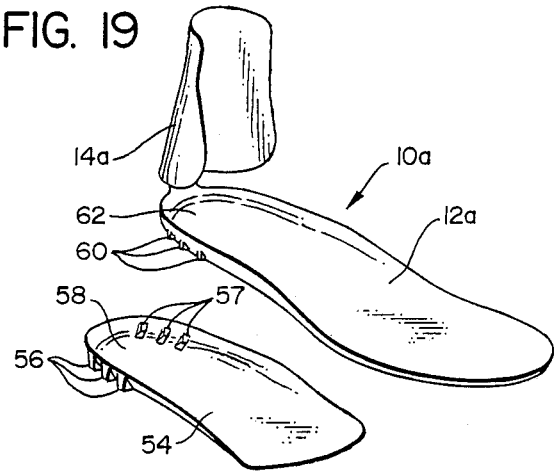
FIG. 19 is an isometric view illustrating two components of a second embodiment of a foot/ankle orthotic of the present invention, with these two components being separated from one another.
Figure 20:
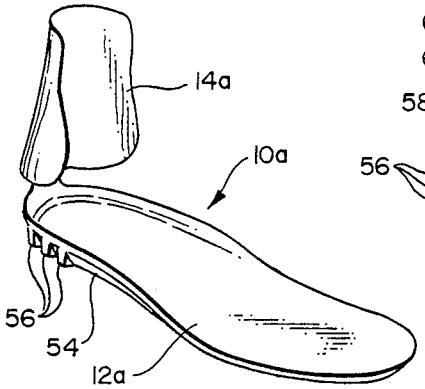
FIG. 20 is an isometric view of the embodiment of FIG. 19, with the two components being joined one to another.

A second embodiment of the present invention is illustrated in FIGS. 19 and 20. Components of this second embodiment which are similar to components of the first embodiment will be given like numerical designations with an "a" suffix distinguishing those of the second embodiment.

The orthotic insert **10*a* of the second embodiment is made of three components. First, there is a foot portion 12*a* and an ankle portion 14*a* which can be substantially the same as, or similar to, the components 12 and 14 of the first embodiment. There is added, however, a relatively rigid cap 54 made of a hard plastic material which is positioned below, and interfits with, the foot portion 12. FIG. 19 shows the cap 54 separated from the foot portion 12*a*, while FIG. 20 shows these assembled. This cap 54 has at the heel portion a plurality of downwardly extending stabilizing elements 56, each having an upwardly facing recess 57. In the particular embodiment shown herein, there are six such stabilizing elements 56, three on each side of the heel portion 58 of the cap 54. Three of these elements 56 are located on the inside of the heel portion 58, and the other three elements 56 are located on the outside heel portion. (The number and arrangement of these stabilizing elements 56 could be varied.) These stabilizing elements serve two functions. First, these have a posting function in that these elements 56 support the heel portion 58 at the proper angular position relative to the underlying boot, and the lower surface of the selected elements 56 may be ground down to optimize the angular positioning of the heel of the foot. The second function of these stabilizing elements 56 is to receive in their recesses 57 matching locating elements or ears 60 which are positioned on the heel portion 62 of the orthotic foot portion 12*a*. These stabilizing elements 56 and locating elements 60** are described more fully in the applicant's U.S. patent application Ser. No. 837,584, for which a U.S. continuation application has been filed, of which this is a continuation-in-part, and the descriptions contained in those patent applications are incorporated herein by reference.

As in the first embodiment, the back surface of the ankle portion **14*a* has a layer of Trico material or other material which will attach to Velcro or some other fastening material. The foot portion 12*a* is interfitted with the rigid cap to form the assembled orthotic 10*a*, and this assembled orthotic insert 10*a* of the second embodiment is mounted in a boot as in the first embodiment, with the ankle portion 14*a* being releasably attached to Velcro strips or the like in the boot. This permits the rear of the foot to be precisely positioned angularly by means of removing material selectively on the stabilizing elements 56, and also the positioning of the ankle portion 14*a*** independently of the components with the foot and also the positioning of the foot and ankle.

Figure 21:
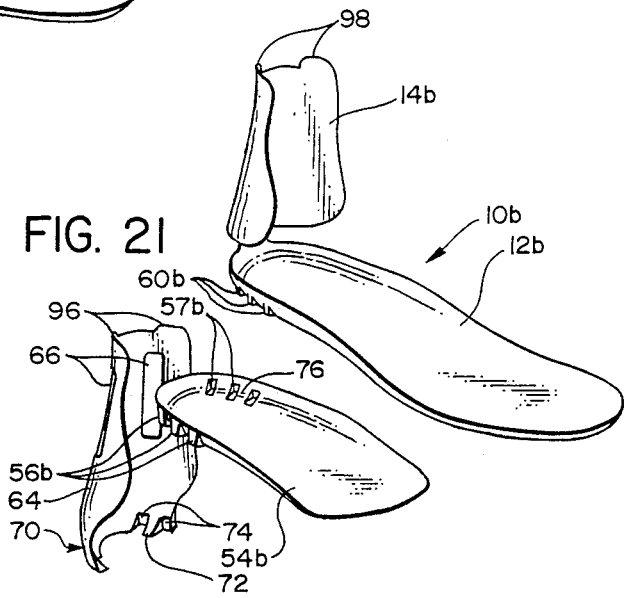
FIG. 21 is an isometric view similar to FIG. 19, but illustrating a second embodiment of the present invention, where the three components of this second embodiment are separated from one another.
Figure 22:
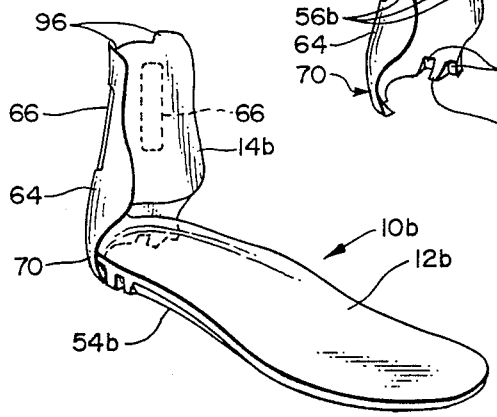
FIG. 22 is a view similar to FIG. 21, but showing the three components assembled.

A third embodiment is illustrated in FIGS. 21 and 22. Components of this third embodiment which are similar to components of the first two embodiments will be given like numerical designations, with a "b"0 suffix distinguishing those of the second embodiment.

The orthotic **10*b* of the third embodiment has a foot portion 12*b*, an ankle portion 14*b*, and a rigid cap 54*b*. These components are substantially the same as in the second embodiment of FIGS. 19 and 20**, so no detailed description of those components will be presented relative to the third embodiment.

There is additionally provided a relatively rigid plastic ankle portion 64 contoured to fit around the rear part of the heel and ankle, and matching the contour of the relatively soft foam ankle portion **14*b*. The rigid ankle portion 64 has a pair of spaced through openings 66 on opposite side portions thereof, and these openings 66 interfit with Velcro strips 42 positioned at the rear surface of the boot. The openings 66 and Velcro strips 42 are shown as having matching rectangular shapes, with the lengthwise dimension of the rectangle being vertically oriented. However, it should be recognized that other configurations of openings 66 and strips 42 could be provided. The engagement of the Velcro strips with the back surface of the ankle portion 14*b* prevents upward movement of the ankle portions 14*b* and 64**.

At the lower end 70 of the rigid ankle portion 64, there are on each side of the rigid ankle portion 64 a laterally inwardly extending finger 72 having two notched portions 74 on each side thereof. Each finger 72 fits inside a notched area 76 between the two rearmost stabilizing elements **56*b* on the rigid cap 54, and the notched areas 74 receive those two rearmost stabilizing elements 56*b*. Thus, the rear stabilizing elements 56 and the two fingers 72, with the notched areas 74 and 76, form a tongue and groove connection with the rigid ankle portion 64 to provide a releasable interconnection. Yet, the connection is sufficiently loose so that a certain degree of forward and rear pivot movement (e.g., 8 degrees to 10 degrees) is permitted between the rigid ankle portion 64 and the rigid cap 54*b*** about the area of interconnection.

Figure 23:
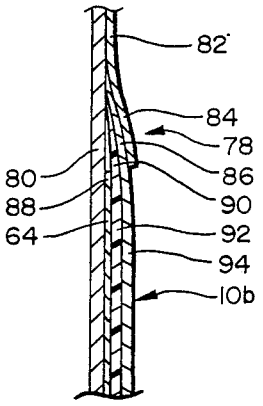
FIG. 23 is a sectional view of an upper edge portion of the ankle portion of an orthotic of the present invention being positioned in a rear ankle portion of a boot with another form of a releasable connection.

Another arrangement to prevent upward movement of the orthotic **10*b* in a boot will be explained with reference to FIG. 23, where there is a releasable connection 78 between the boot and the orthotic 10*b*. More specifically, as illustrated in FIG. 23, the rear ankle portion of the boot (shown at 80) has an inner lining material 82 which is formed at its lower end with a flap 84, the lower end of which can move outwardly to a moderate degree. The upper edge portion 86 of the orthotic 10*b* fits between the flap 84 and the boot ankle portion 80. Thus, as can be seen in FIG. 23, this upper edge portion 86 comprises the upper edge portion 88 of the rigid ankle portion 64, and the upper edge 90 of two layers 92 and 94 that make up the relatively less rigid ankle portion 14*b*. The upper edge 86 of the rigid ankle portion 64 can be provided with a pair of upstanding ears 96 to facilitate the inter-engagement of the rigid ankle portion 64 and the flap 84, and the more yielding ankle portion 14*b* can be provided with similarly shaped ears 98. (See FIG. 21 and 22**.)

Figure 24:
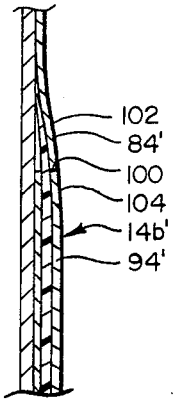
FIG. 24 is a view similar to FIG. 23, but showing a modified form in which the upper edge portion of the ankle portion of the orthotic fits within the ankle portion of the boot.

There is shown in FIG. 24 a somewhat modified form of the connection 78, and in describing this modified connection, numerical designations corresponding to FIGS. 23 will be used, with a prime (') designation distinguishing the configuration of FIG. 24.

The inner layer 94' of the ankle portion 14b' has its upper edge 100 terminated at the location of the lower edge of the flap 84'. Thus, the inner surface 102 of the flap 100 meets the inner surface 104 of the layer 94 to make a substantially continuous surface.

With regard to the operation of the third embodiment shown in FIGS. 21 and 22, the rigid ankle portion 64 is releasably connected to the rear end of the rigid cap 54b by interfitting the stabilizing elements 56 and fingers 52 in tongue and groove fashion, as shown in FIG. 22. Then, the foot portion 12b is laid upon the rigid cap 54, and the ankle portion 14b is positioned against the rigid ankle portion 64. The assembled orthotic, as shown in FIG. 22, is then placed in a boot (e.g., a skate boot or a hiking boot), with the rigid ankle portion 64 and the more yielding ankle portion 14b being restrained, relative to any upward movement by reason of the Velcro strips 42, or in an alternate configuration by the connection 78 (see FIGS. 23 and/or FIG. 24). It is to be understood that other means could be used to releasably connect the rigid ankle portion 64 and the ankle portion 14b.

Figure 25:
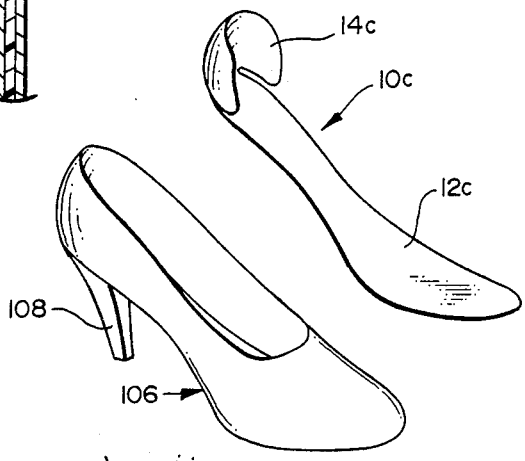
FIG. 25 is an isometric view, similar to FIG. 19 and 21, but showing a fourth embodiment of the present invention adapted to fit within a woman's high heeled show.

A fourth embodiment is shown in FIG. 25, and there is an orthotic 10c arranged to fit in a lady's show 106 having a high heel 108. The orthotic 10c has an upstanding ankle portion 14c and a foot portion 12c. This orthotic 10c can incorporate features already described with respect to the prior three embodiments or other features described herein. More specifically, the rear portion 14c is removably secured to the rear of the shoe and is arranged to grip the rear portion of the foot to prevent upward movement thereof. Further, this could be a full length orthotic (as shown), a three quarter length orthotic, or even shorter.

In FIGS. 26 through 28, there is shown the manner in which either of the orthotic inserts 10a or 10b could be custom fit to a person's foot. This particular operation will be described with reference to the orthotic 10b of the third embodiment, illustrated in FIGS. 21 and 22. This method is quite similar to the method described in the applicant's co-pending U.S. patent application, Ser. No. 06/837,584, filed Mar. 7, 1986, entitled "ORTHOTIC AND METHOD OF MAKING THE SAME". As indicated previously, the subject matter of that application is incorporated herein by reference.

Generally, the first step is to have the person for whom the pair of orthotics is being made sit on a raised chair. The rigid cap 54b and the rigid ankle portion 64 are initially placed against the person's foot to check for size. Desirably, the leading edge of the cap 54b should reach just behind the metatarsal heads of the person's foot. The cap 54b and ankle portion 64 are placed in an oven and heated to a moderately elevated temperature (150 degrees to 300 degrees F.) so that the material is sufficiently yielding so that it can be deformed and contoured to the person's foot. After the cap 54b and rigid ankle portion 64 have been adequately heated, they are pressed against the foot portion 12b and ankle portion 14b, respectively. As described previously, the lower locating elements 60b interfit with the recesses 57b in the stabilizing elements 56b. If desired, the upper surface of the cap 54b can be provided with a suitable adhesive which softens when heated, so that the foot portion 14b becomes bonded to the cap 54b when these are cooled. A similar arrangement can be made with respect to the ankle portion 14b and the rigid ankle portion 64. Alternatively, these components can be removably engaged with one another.

Next, there is the utilization of a vacuum forming technique to properly for the orthotic 10b to the foot. As illustrated in FIG. 26, there is a suction tube 110 that is applied to the person's ankle by means of a fitting 112 and an elastic band 114. The intake end 116 of the tube 110 is on the upper surface of the person's midfoot. The orthotic 10b is placed against the person's foot, and an elastic band 118 is slipped around the foot to hold the assembled orthotic 10b in place against the bottom of the foot and against the rear ankle portion.

As illustrated in FIG. 27, the next step is to place a flexible transparent plastic bag 120 around the foot and upwardly around the ankle. As illustrated in FIG. 28, the upper part of the bag 120 which is around the ankle is pressed against the ankle by means of a peripheral band 122. The assembled components (i.e., the foot portion 12b, the ankle portion 14b, the rigid cap 54b and the rigid ankle portion 64) are then pressed gently against the person's foot and ankle. Then a vacuum pump is turned on to suck the air through the tube inlet 116 to cause the bag 120 to press the assembled components against the bottom of the person's foot and the back of the person's ankle with the appropriate pressure.

Then, as shown in FIG. 28, the operator positions the foot and ankle in the desired position, and then specifically positions the forward part of the foot appropriate relative to the rear part of the foot. As indicated previously, this will generally be done in a manner so that the foot is in the neutral position, with the forward part of the foot being positioned so that the midtarsal joint is in its locked or nearly locked position.

It is to be understood that the cap 54b and the rigid ankle portion 64 are, because of being heated, sufficiently yielding so that the force of the atmospheric pressure (resulting from the application of the vacuum in the bag 120) is sufficient to shape these components so that they will properly conform to the lower portion of the person's foot and the rear portion of the person's ankle. Thus, with the operator properly positioning the person's foot and ankle, the orthotic 10b assumes a shape intimately corresponding to the plantar surface of the person's foot, and the foot being held in the optimized position and also properly positioned relative to the rear ankle portion 14b, as discussed above.

Within a short time, the cap 54b and the rigid ankle portion 64 will cool to room temperature, so that these will harden into the proper configuration which they had assumed during the vacuum forming step described above. An orthotic 10b for the other foot is made in substantially the same manner as described above. Then, the stabilizing elements 56b can, if necessary, be ground appropriately to properly position the angle of the heel relative to the forefoot.

A modification of the method of the present invention will now be described with reference to FIGS. 29 through 31. A quite similar process to that shown in FIGS. 29 through 31 is illustrated in the applicant's co-pending U.S. patent application Ser. No. 06/870,123, filed June 3, 1986, entitled "ORTHOTIC INSERT AND METHOD OF MAKING THE SAME". The subject matter of that application is incorporated herein by reference.

The foot portion 12b can, in this modification, be formed as a material which, when heated, will change shape to conform to the person's foot. This material could be, for example, a cork-like material.

In this modification, the cork-like material is also heated in the oven to a temperature where it yields moderately, and this material is placed on the rigid cap member 54b. Then the vacuum bag 120 is placed over the assembled orthotic as described above, and the foot is properly positioned as illustrated in FIG. 28.

Then, as illustrated in FIG. 29, the person for whom the orthotic is being made is asked to step down from the chair, bearing his or her wight on the other foot in a manner so as to make lightweight contact of the orthotic 14b with a base member 124 which is contoured to represent the sole of the boot into which the orthotic 14b is to be inserted. (Under some circumstances, the forming can be accomplished solely by the vacuum, without the person placing weight on the foot. Also, the vacuum bag can be placed around the person's foot with a boot being on the foot.)

Then, with the person's feet being about four to five inches apart, the person is asked to flex his or her knees forwardly so that the person's knees are positioned above the forward part of the foot. This motion is illustrated in FIGS. 31. When the person's position is stable, the person is asked to transfer his or here weight equally to both feet. The operator holds the tibia steady, and the person is asked to sit down. At the same time, the operator picks up the person's foot on which the orthotic 10b is placed, and repositions the foot in the neutral and locked position. The foot is held in the neutral and locked position for approximately thirty seconds. At the same time, the temperature of the components has dropped so that the entire orthotic hardens, and the basic structure of the orthotic 10b is formed. The bag 120 and the various bands are removed from the person's foot and ankle, and the orthotic 10b is removed. Then the entire procedure is simply repeated with the person's other foot.

Figure 32:
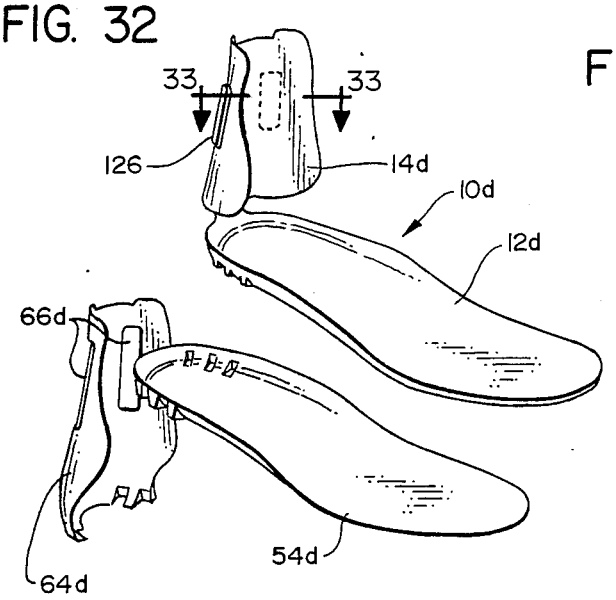
FIG. 32 is an isometric view similar to FIG. 21, illustrating a fifth embodiment of the present invention.
Figure 33:
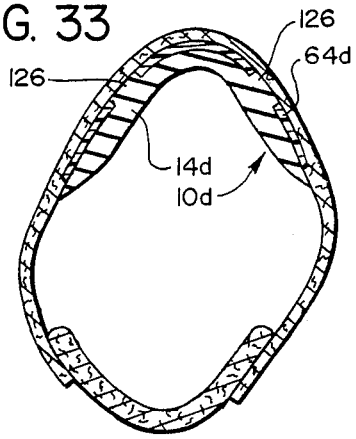
FIG. 33 is a sectional view taken along line 33—33 and illustrating the second embodiment of the present invention positioned in its assembled form in a boot.
Figure 35:
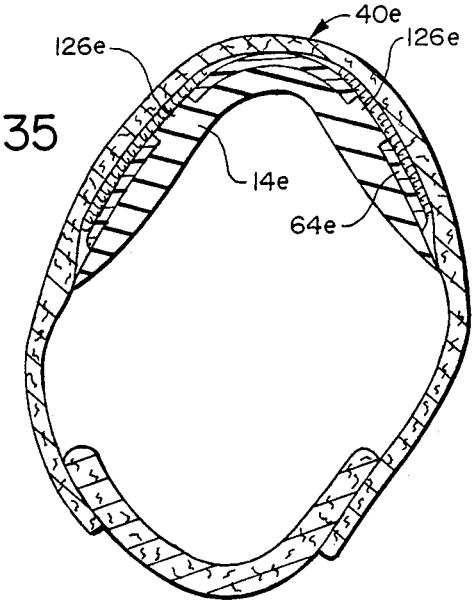
FIG. 35 is a sectional view, similar to FIG. 33, and showing a modified form of securing the orthotic of FIG. 32 to a boot.

A fifth embodiment of the present invention is illustrated in FIGS. 32 and 33. Components of the present embodiment which are similar to components of the previous embodiments will be given like numerical designations, with a "d" suffix distinguishing those of the fifth embodiment.

The orthotic 10d comprises a relatively yielding foot portion 12d, a relatively yielding ankle portion 14d, a relatively hard cap portion 54d and a relatively hard ankle portion 64d. These components are substantially the same as in the third embodiment, shown in FIGS. 21 and 22, except that there are protrusions 126 which are formed in the back surface of the heel portion 14d, and these protrusions 126 fit into the openings 66d in the rigid ankle portion 64d. The ankle portions 14d and 64d are then releasably held in the boot as indicated in FIGS. 23 or 24.

Figure 34:
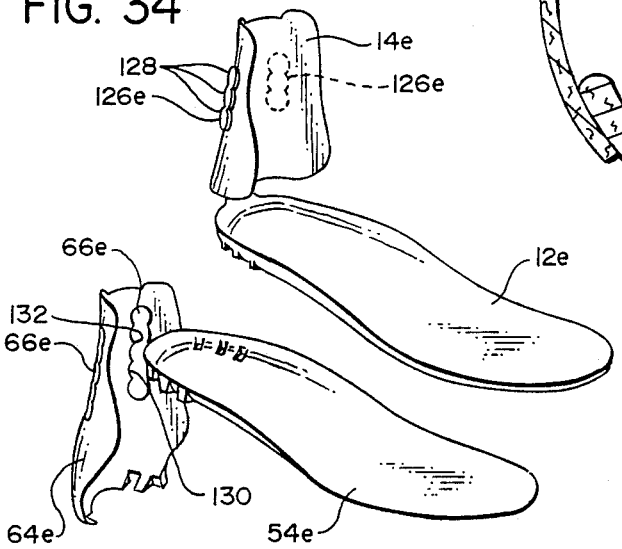
FIG. 34 is an isometric view similar to FIG. 32, showing a sixth embodiment of the present invention.

A sixth embodiment is illustrated in FIG. 34. The components of this sixth embodiment which are similar to other components will be given like numerical designations, with an "e" suffix distinguishing those of this sixth embodiment. This sixth embodiment is essentially the same as the fifth embodiment shown in FIGS. 32 and 33, except that the two protrusions 126e are formed as a plurality of interconnected partial circular portions 128. The matching openings 66e have a configuration matching those of the circular portions 128. Thus, there are wider opening portions 130 with narrower portions 132 separating the wider portions 130. By placing the circular protruding portions 128 in selected opening locations 130, the vertical location of the ankle portion 14e can be varied. The rear surfaces of the protrusions 126e are formed with a material (e.g., Trico) which will releasably attach to Velcro strips.

Figure 36:
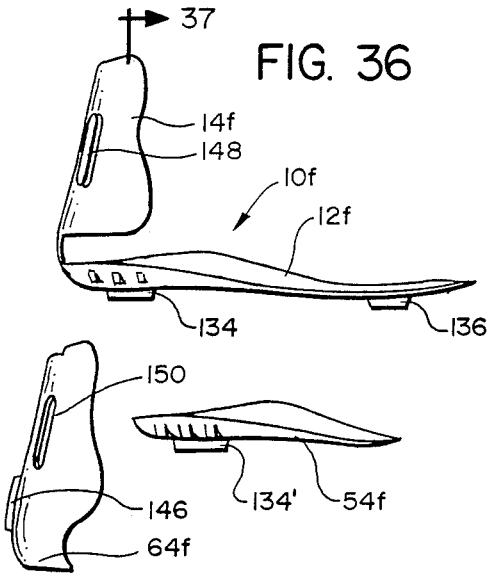
FIG. 36 is a side elevational view showing a seventh embodiment of the present invention, with the orthotic being particularly arranged and configured to be positioned in a skate boot but with the components separated from one another.
Figure 37:
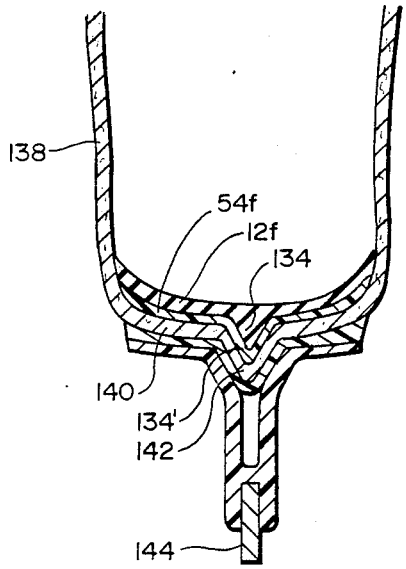
FIG. 37 is a sectional view taken along line 37—37 of FIG. 36, and showing the embodiment of FIG. 36 in its assembled form in a skate boot.
Figure 38:
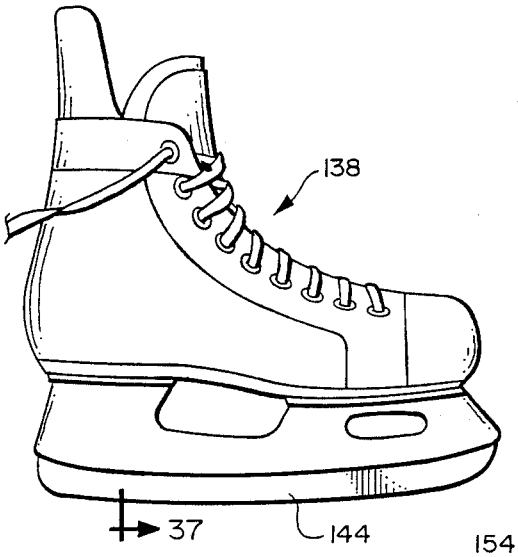
FIG. 38 is an isometric view of the present invention, where the ankle portion of the foot/ankle orthotic is extended upwardly so as to act as an ankle brace.
Figure 38:
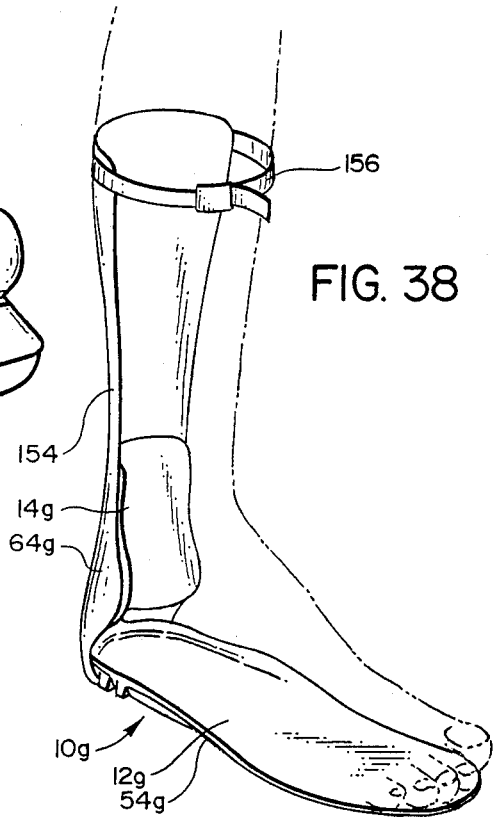

A seventh embodiment of the present invention is illustrated in FIGS. 36 and 37, with components of this seventh embodiment being distinguished from corresponding components of the prior embodiments (which have like numerical designations) by an "f" suffix. There is the relatively yielding foot portion 12f and the relatively rigid cap 54f.

The yielding foot portion 12f has a rear and forward downwardly extending "V" shaped protrusion 134 and 136, respectively, positioned along the longitudinal center axis of the orthotic 10f. The rigid foot portion 54f has a single rear downwardly extending protrusion 134' which is formed with a "V" shaped recess to receive the protrusion 134.

There is a skate boot 138, and the sole 140 of the boot 38 has rear and forward center recesses 142 to accept the rear protrusions 134 and 134' and also the forward protrusion 136, respectively. It is to be understood that the configuration of these protrusions 134 and 136 could be varied, and there could be one single long protrusion incorporating both of the protrusions 134 and 136. Further, while the rigid foot portion 54f is shown as a three quarter length member, this could also be a full length member with a second forward protrusion interfitting with the forward protrusion 136.

The function of these protrusions 134 and 136 are described more fully in the applicant's co-pending application, Ser. No. 06/899,958, filed Aug. 25, 1986, entitled "SKATE BOOT ASSEMBLY", and that application is incorporated herein by reference. This arrangement properly aligns the orthotic 10f so that greater control can be exerted through the orthotic 10f into the skate boot 138. Further, the force exerted form the skate boot blade 144 upwardly through the boot structure and into the orthotic is accomplished in such a way that greater control is obtained from the person's foot down through the skate boot structure.

In addition, the rear surface of the rigid ankle portion 64f is provided with a rear protrusion 146 which fits in a matching recess in the skate boot (not shown herein for ease of illustration) to limit upward movement of the rigid ankle portion 64f. Since this feature is disclosed and discussed in some detail in the applicant's co-pending application, Ser. No. 06/899,958, that will not be described in detail herein. Further, there are protrusions 148 in the more yielding ankle portion 14 which interfits with recesses formed in protrusions 150 on the rigid ankle portion 64f. The interfitting of the protruding portions 148 and 150 provides for releasable engagement between the ankle portion 14f and the rigid ankle portion 64f to limit vertical movement of these components.

With regard to a skate boot particularly, one of the essential advantages is that he overall orthotic 10f not only properly supports, positions and aligns the foot, but also that there is proper support for the ankle. Further, the pivoting interengagement of the ankle portions 14f and 64f permit limited forward-to-rear flexing of the ankle, while providing lateral support. Also, as indicated earlier, the inwardly protruding portions of the ankle portion 14f grip the ankle above the heel in an opposite side of the Achilles tendon to properly hold the ankle and rear foot portion in the skate, permitting no significant upward slippage or movement of the rear foot portion relative to the boot. The effect of this is to eliminate the need for the rather expensive "L" pads which are required in sewn skate boots or the like. The net result is that a rather conventional skate boot can be provided, and the orthotic 10*f* of the present invention can be used in a more or less conventional skate boot to engage the foot in an optimized manner, giving proper positioning and support.

Another advantage of the present invention is that in a facility which rents skate boots, ski boots or the like, orthotic inserts of the present invention could also be rented to be used in conjunction with such boots. The selected orthotic could conform more closely to the person's foot and thus improve the overall fit, in accordance with the teachings described herein.

Also, as indicated previously, the various embodiments described herein can be used in a skate boot, or other types of a boot (e.g., a ski boot or a hiking boot). Also, within the broader scope of the present invention, these can be used in footwear that is not a boot.

Finally, an eighth embodiment of the present invention is shown in FIGS. 37. Components of this eight embodiment which are similar to components of the earlier embodiments, have like numerical designations with a "g" suffix distinguishing those of the eight embodiment. The main distinction in this eight embodiment is that the rigid ankle portion 64*g* is extended upwardly, as at 154 to form a the brace portion 154 to firmly engage the rear portion of the person's lower leg so as to stabilize the ankle. In other respects, the orthotic 10*g* of the present embodiment can be similar to one or more of the prior embodiments.

It is to be understood that various modifications could be made in the present invention without departing from the basic teachings thereof.

What is claimed is:

1. A boot and orthotic assembly comprising:

a. a boot comprising a sole with an upper surface adapted to support a plantar surface of a foot and an upstanding ankle portion adapted to operatively engage rear and side heel and ankle portions of the foot;

b. an orthotic insert adapted to be removable positioned within said boot, said orthotic insert comprising:

(1) an orthotic foot portion adapted to overlie the sole of the boot and to engage the plantar surface of the foot to properly position the foot;

(2) an orthotic ankle portion adapted to be positioned adjacent the ankle portion of the boot, said orthotic ankle portion having inward protruding areas which are positioned to snugly engage a person's lower recessed ankle regions on opposite sides of an Achilles tendon of the person and above the person's lower rear heel region;

c. said orthotic insert and said boot having releasable interconnecting means by which said orthotic insert can be releaseably secured to said boot to restrain upward movement of the orthotic ankle portion relative to the ankle portion of the boot, said releasable interconnecting means having an operative releasable engagement between the orthotic ankle portion and the ankle portion of the boot;

whereby when the orthotic insert is positioned in the boot, with the interconnecting means securing the orthotic insert to the boot, and with the inward protruding areas engaging the person's recessed ankle regions, upward movement of the person's heel and ankle portions relative to the ankle portion of the boot is restrained.

2. The assembly as recited in claim 1, wherein said interconnecting means comprises first and second connecting members positioned on adjacent surface portions of the orthotic ankle portion and the ankle portions of the boot respectively, with the first and second connecting members being adapted to releasably engage one another.

3. The assembly as recited in claim 2, wherein one of said connecting members if a Velcro-like member, and the other connecting member is connectably compatible to releasably engage said Velcro-like member.

4. The assembly as recited in claim 1, wherein said releasable interconnecting means comprises first means which defines a recess in the ankle portion of the boot, and an interconnecting portion of said orthotic ankle portion which is received in said recess.

5. The assembly as recited in claim 4, wherein said first means to define said recess comprises a member positioned at said ankle portion of the boot to define the recess which has a downwardly extending recess opening, and an upper edge portion of said orthotic ankle portion extends into the recess.

6. The assembly as recited in claim 5, wherein the member defining the recess extends over a surface of the ankle portion of the boot, and the orthotic ankle portion has a layer of material matching a surface contour of said member defining the recess so that the member defining the recess and the ankle portion of the boot define a relatively smooth surface to engage the ankle portion of the person.

7. A boot and orthotic assembly comprising:

a. a boot comprising a sole with an upper surface adapted to support a plantar surface of a foot and an upstanding ankle portion adapted to operatively engage rear and side heel and ankle portions of the foot;

b. an orthotic insert adapted to be removably positioned within said boot, said orthotic insert comprising:

(1) an orthotic foot portion adapted to overlie the sole of the boot and to engage the plantar surface of the foot to properly position the foot;

(2) an orthotic ankle portion adapted to be positioned adjacent the ankle portion of the boot, said orthotic ankle portion having inward protruding areas which are positioned to snugly engage a person's lower recessed ankle regions on opposite sides of an Achilles tendon of the person and above the person's lower rear heel region;

c. said orthotic insert and said boot having releasable interconnecting means by which said orthotic insert can be releasably secured to said boot to restrain upward movement of the orthotic ankle portion relative to the ankle portion of the boot;

d. said orthotic foot portion and said orthotic ankle portion being interconnected by position adjustable interconnecting means which permits said orthotic ankle portion to be vertically adjusted relatively to said orthotic foot portion, said interconnecting means being arranged to interconnect the orthotic ankle portion to the ankle portion of the boot at different vertical positions of the orthotic ankle portion;

whereby when the orthotic insert is positioned in the boot, with the interconnecting means securing the orthotic insert to the boot, and with the inward protruding areas engaging the person's recessed ankle regions, upward movement of the person's heel and ankle portions relative to the ankle portion of the boot is restrained.

8. The assembly as recited in claim 7, wherein said interconnecting means comprises first and second members mounted to surface portions of the orthotic ankle portion and the ankle portion of the boot, with said connecting members having respective connecting surface portions which can interengage at various interconnecting locations relative to one another.

9. A boot and orthotic assembly comprising:

a. a boot comprising a sole with an upper surface adapted to support a plantar surface of a foot and an upstanding ankle portion adapted to operatively engage rear and side heel and ankle portions of the foot;

b. an orthotic adapted to be removably positioned within said boot, said orthotic insert comprising:

(1) an orthotic foot portion adapted to overlie the sole of the boot and to engage the plantar surface of the foot to properly position the foot;

(2) an orthotic ankle portion adapted to be positioned adjacent the ankle portion of the boot, said orthotic ankle portion having inward protruding areas which are positioned to snugly engage a person's lower recessed ankle regions on opposite sides of an Achilles tendon of the person and above the person's lower rear heel region;

c. said orthotic insert and said boot having releasable interconnecting means by which said orthotic insert can be releasably secured to said boot to restrain upward movement of the orthotic ankle portion relative to the ankle portion of the boot;

d. said orthotic foot portion comprising an upper relatively yielding orthotic foot section and a lower relatively rigid orthotic foot section, said upper and lower orthotic foot sections having interfitting protrusion and recess means which interengage to restrict relative movement between said upper and lower orthotic foot portions;

whereby when the orthotic insert is positioned in the boot, with the interconnecting means securing the orthotic insert to the boot, and with the inward protruding areas engaging the person's recessed ankle regions, upward movement of the person's heel and ankle portions relative to the ankle portion of the boot is restrained.

10. The assembly as recited in claim 9, wherein said upper orthotic foot section has a plurality of downwardly extending protrusions which fit in recesses formed by matching downwardly extending protrusions of said lower orthotic foot portion.

11. The assembly as recited in claim 10, wherein the protrusions of the lower orthotic foot portion are located at least partially at a heel region of said lower orthotic foot section and function to stabilize the heel portion of the foot with regard to angular positioning of the heel portion of the foot.

12. The assembly as recited in claim 9, wherein the relatively rigid lower section of the orthotic foot portion has a plurality of protrusions positioned at least at a heel region of said lower orthotic foot portion, with said protrusions functioning as stabilizing elements to control angular position of a heel of the person's foot.

13. The assembly as recited in claim 9, wherein the orthotic ankle portion comprises a forward relatively yielding orthotic ankle section, and an adjacent rear relatively rigid orthotic ankle section, with said forward and rear orthotic ankle sections interengaging one another.

14. The assembly as recited in claim 13, wherein the rear orthotic ankle section has an operative interconnection with said lower orthotic foot section which permits at least limited angular movement forwardly and rearwardly of the rear rigid orthotic ankle section.

15. The assembly as recited in claim 13, wherein said lower orthotic foot section has at a heel region thereof a plurality of downward protrusions which are stabilizing elements to control angular position of said orthotic foot portion, and said rear orthotic ankle section has a lower end portion which interfits with said protrusions to provide the operative connection between the rear orthotic ankle section and the lower orthotic foot section.

16. The assembly as recited in claim 13, wherein said rear orthotic ankle section is provided with opening means, and the releasable interconnecting means comprises at least one connecting member extending through said opening means to interconnect the forward orthotic ankle section with the ankle portion of the boot.

17. The assembly as recited in claim 14, wherein said interconnecting means comprises a first connecting member positioned at an inside surface of said ankle portion of the boot and defining a downwardly extending connecting recess, and an upwardly extending edge portion of the orthotic ankle portion is arranged to interfit in the connecting recess.

18. The assembly as recited in claim 17, wherein the forward and rear orthotic ankle sections have vertically adjustable interfitting recess and protrusion connecting means permitting said forward and rear orthotic ankle sections to be connected to one another at varying relative vertical locations.

19. The assembly as recited in claim 13, wherein the forward and rear orthotic ankle sections have vertically adjustable interfitting recess and protrusion connecting means permitting said forward and rear orthotic ankle sections to be connected to one another at varying relative vertical locations.

20. A boot and orthotic assembly comprising:

a. a boot comprising a sole with an upper surface adapted to support a plantar surface of a foot and an upstanding ankle portion adapted to operatively engage rear and side heel and ankle portions of the foot;

b. an orthotic insert adapted to be removably positioned within said boot, said orthotic insert comprising:

(1) an orthotic foot portion adapted to overlie the sole of the boot and to engage the plantar surface of the foot to properly position the foot;

(2) an orthotic ankle portion adapted to be positioned adjacent the ankle portion of the boot, said orthotic ankle portion having inward protruding areas which are positioned to snugly engage a person's lower recessed ankle regions on opposite sides of an Achilles tendon of the person and above the person's lower rear heel region;

c. said orthotic insert and said boot having releasable interconnecting means by which said orthotic insert can be releasably secured to said boot to restrain upward movement of the orthotic ankle portion relative to the ankle portion of the boot;

d. said orthotic foot portion having downwardly extending protrusion means positioned to interfit with corresponding recess means in the sole of the boot, whereby lateral movement of the orthotic foot portion relative to the sole of the boot is inhibited, said orthotic foot portion further comprising an upper relatively yielding orthotic foot section and a lower relatively rigid orthotic foot section, with at least said lower relatively rigid orthotic foot section having said protrusion means;

whereby when the orthotic insert is positioned in the boot, with the interconnecting means securing the orthotic insert to the boot, and with the inward protruding areas engaging the person's recessed ankle regions, upward movement of the person's heel and ankle portions relative to the ankle portion of the boot is restrained.

21. The assembly as recited in claim 20, wherein both of said upper and lower orthotic foot sections have said protrusion means, whereby lateral movement of both of said orthotic foot sections is inhibited.

22. An orthotic insert adapted to be removably positioned in a boot comprising a sole with an upper surface adapted to support a plantar surface of a foot and an upstanding ankle portion adapted to operatively engage rear and side heel and ankle portions of the foot, said orthotic insert comprising:

a. an orthotic foot portion adapted to overlie the sole of the boot and to engage the plantar surface of the foot to properly position the foot;

b. an orthotic ankle portion adapted to be positioned adjacent the ankle portion of the boot, said orthotic ankle portion having inward protruding areas which are positioned to snugly engage a person's lower recessed ankle regions on opposite sides of an Achilles tendon of the person and above the person's lower rear heel region;

c. said orthotic insert and said boot having releasable interconnecting means by which said orthotic insert can be releasably secured to said boot to restrain upward movement of the orthotic ankle portion relative to the ankle portion of the boot;

d. said releasable interconnecting means is arranged to have an operative releasable engagement between the orthotic ankle portion and the ankle portion of the boot;

whereby when the orthotic insert is positioned in the boot, with the interconnecting means securing the orthotic insert to the boot, and with the inward protruding areas engaging the person's recessed ankle regions, upward movement of the person's heel and ankle portions relative to the ankle portion of the boot is restrained.

23. The orthotic insert as recited in claim 22, wherein said interconnecting means comprises a connecting member positioned on a surface portion of the orthotic ankle portion which is adjacent to a surface of the ankle portion of the boot, with the connecting member being adapted to releasably engage a matching connecting member at said surface of the ankle portion of the boot.

24. The orthotic insert as recited in claim 23, wherein said connecting member is a Velcro-related surface member adapted to engage a Velcro-related surface member of said boot.

25. The orthotic insert recited in claim 22, wherein said releasable interconnecting means comprises an interconnecting portion of said orthotic ankle portion which is adapted to be received in a recess in the ankle portion of the boot.

26. An orthotic insert adapted to be removably positioned in a boot comprising a sole with an upper surface adapted to support a plantar surface of a foot and an upstanding ankle portion adapted to operatively engage rear and side heel and ankle portions of the foot, said orthotic insert comprising:

a. an orthotic foot portion adapted to overlie the sole of the boot and to engage the plantar surface of the foot to properly position the foot;

b. an orthotic ankle portion adapted to be positioned adjacent the ankle portion of the boot, said orthotic ankle portion having inward protruding areas which are positioned to snugly engage a person's lower recessed ankle regions on opposite sides of an Achilles tendon of the person and above the person's lower rear heel region;

c. said orthotic insert and said boot having releasable interconnecting means by which said orthotic insert can be releasably secured to said boot to restrain upward movement of the orthotic ankle portion relative to the ankle portion of the boot;

d. said orthotic foot portion comprising an upper relatively yielding orthotic foot section and a lower relatively rigid orthotic foot section, said upper and lower orthotic foot sections having interfitting protrusion and recess means which interengage to restrict whereby when the orthotic insert is positioned in the boot, with the interconnecting means securing the orthotic insert to the boot, and with the inward protruding areas engaging the person's recessed ankle regions, upward movement of the person's heel and ankle portions relative to the ankle portion of the boot is restrained.

27. The assembly as recited in claim 26, wherein said upper orthotic foot section has a plurality of downwardly extending protrusions which fit in recesses formed by matching downwardly extending protrusions of said lower orthotic foot portion.

28. The orthotic insert as recited in claim 27, wherein the protrusions of the lower orthotic foot portion are located at least partially at a heel region of said lower orthotic foot section and function to stabilize the heel portion of the foot with regard to angular positioning of the heel portion of the foot.

29. The orthotic insert as recited in claim 26, wherein the relatively rigid lower section of the orthotic foot portion has a plurality of protrusions positioned at least at a heel region of said lower orthotic foot portion, with said protrusions functioning as stabilizing elements to control angular position of a heel of the person's foot.

30. The orthotic insert as recited in claim 26, wherein the orthotic ankle portion comprises a forward relatively yielding orthotic ankle section, and an adjacent rear relatively rigid orthotic ankle section, with said forward and rear orthotic ankle sections interengaging one another.

31. The orthotic insert as recited in claim 30, wherein the rear orthotic ankle section has an operative interconnection with said lower orthotic foot section which permits at least limited angular movement forwardly and rearwardly of the rear rigid orthotic ankle section.

32. The assembly as recited in claim 30, wherein said lower orthotic foot section has at a heel region thereof a plurality of downward protrusions which are stabilizing elements to control angular position of said orthotic foot portion, and said rear orthotic ankle section has a lower end portion which interfits with said protrusions to provide the operative connection between the rear orthotic ankle section and the lower orthotic foot section.

33. The orthotic insert as recited in claim 30, wherein said rear orthotic ankle section is provided with opening means, and the releasable interconnecting means comprises at least one connecting member extending through said opening means to interconnect the forward orthotic ankle section with the ankle portion of the boot.

34. The orthotic insert as recited in claim 30, wherein the forward and rear orthotic ankle sections have vertically adjustable interfitting recess and protrusion connecting means permitting said forward and rear orthotic ankle sections to be connected to one another at varying relative vertical locations.

35. An orthotic adapted to be removably positioned in a boot comprising a sole with an upper surface adapted to support a plantar surface of a foot and an upstanding ankle portion adapted to operatively engage rear and side heel and ankle portions of the foot being adapted to be positioned adjacent the ankle portion of the boot;

said orthotic insert having inward protruding areas which are positioned to snugly engage a person's lower recessed ankle regions on opposite sides of an Achilles tendon of the person and above the person's lower rear heel region, said orthotic insert having releasable interconnecting means by which said orthotic insert can be releasably secured to said boot to restrain upward movement of the orthotic insert relative to the ankle portion of the boot, said interconnecting means comprising a connecting member positioned on a surface portion of the orthotic insert which is adjacent to the ankle portion of the boot, with the connecting member being adapted to releasable engage a matching connecting member at surface of the ankle portion of the boot;

whereby when the orthotic insert is positioned in the boot, with the interconnecting means securing the orthotic insert to the boot, and with the inward protruding areas engaging the person's recessed ankle regions, upward movement of the person's heel and ankle portions relative to the ankle portion of the boot is restrained.

36. The orthotic insert as recited in claim 35, wherein said connecting member is a Velcro-related surface member adapted to engage Velcro-related surface member of said boot.

37. A boot and orthotic assembly comprising:

a. a boot comprising a sole with an upper surface adapted to support a plantar surface of a foot and an upstanding ankle portion adapted to operatively engage rear and side heel and ankle portions of the foot;

b. an orthotic insert adapted to be removably positioned within said boot, said orthotic insert comprising:

(1) an orthotic foot portion adapted to overlie the sole of the boot and to engage the plantar surface of the foot to properly position the foot;

(2) an orthotic ankle portion adapted to be positioned adjacent the ankle portion of the boot, said orthotic ankle portion having inward protruding areas which are positioned to snugly engage a person's lower recessed ankle regions on opposite sides of an Achilles tendon of the person and above the person's lower rear heel region;

c. said orthotic insert and said boot having releasable interconnecting means by which said orthotic insert can be releasable secured to said boot the restrain upward movement of the orthotic ankle portion relative to the ankle portion of the boot;

d. said orthotic foot portion having downwardly extending protrusion means positioned to interfit with corresponding recess means in the sole of the boot, whereby lateral movement of the orthotic foot portion relative to the sole of the boot is inhibited, said orthotic ankle portion extending upwardly from an ankle location so as to have an upper orthotic ankle portion which engages a person's leg above the person's ankle; whereby when the orthotic insert is positioned in the boot, with the interconnecting means securing the orthotic insert to the boot, and with the inward protruding areas engaging the person's recessed ankle regions, upward movement of the person's heel and ankle portions relative to the ankle portion of the boot is restrained.

38. An orthotic insert adapted to be removably positioned in a boot comprising a sole with an upper surface adapted to support a plantar surface of a foot and an upstanding ankle portion adapted to operatively engage rear and side heel and ankle portions of the foot, said orthotic insert comprising:

a. an orthotic foot portion adapted to overlie the sole of the boot and to engage the plantar surface of the foot to properly position the foot;

b. an orthotic ankle portion adapted to be positioned adjacent the ankle portion of the boot, said orthotic ankle portion having inward protruding areas which are positioned to snugly engage a person's lower recessed ankle regions on opposite sides of an Achilles tendon of the person and above the person's lower rear heel region;

c. said orthotic insert and said boot having releasable interconnecting means by which said orthotic insert can be releasably secured to said boot to restrain upward movement of the orthotic ankle portion relative to the ankle portion of the boot;

d. said orthotic foot portion and said orthotic ankle portion being interconnected by position adjustable interconnecting means which permits said orthotic ankle portion to be vertically adjusted relatively to said orthotic foot portion, said interconnecting means being arranged to interconnect the orthotic ankle portion to the ankle portion of the boot at different vertical positions of the orthotic ankle portion;

whereby when the orthotic insert is positioned in the boot, with the interconnecting means securing the orthotic insert to the boot, and with the inward protruding areas engaging the person's recessed ankle regions, upward movement of the person's heel and ankle portions relative to the ankle portion of the boot is restrained.

* * * * *